US009520014B1

(12) United States Patent
Moshier et al.

(10) Patent No.: US 9,520,014 B1
(45) Date of Patent: Dec. 13, 2016

(54) SYNCHRONIZING SOUNDTRACKS ACROSS WAGERING GAME MACHINES

(75) Inventors: Joshua C. Moshier, Evanston, IL (US); Howard R. Pfeifer, Chicago, IL (US); Paul J. Radek, Naperville, IL (US); Steven J. Zoloto, Highland Park, IL (US)

(73) Assignee: BALLY GAMING, INC., Las Vegas, NV (US)

( * ) Notice: Subject to any disclaimer, the term of this patent is extended or adjusted under 35 U.S.C. 154(b) by 1152 days.

(21) Appl. No.: 13/342,871

(22) Filed: Jan. 3, 2012

Related U.S. Application Data

(60) Provisional application No. 61/429,322, filed on Jan. 3, 2011.

(51) Int. Cl.
*G07F 17/32* (2006.01)
*A63F 9/24* (2006.01)

(52) U.S. Cl.
CPC *G07F 17/32* (2013.01); *A63F 9/24* (2013.01)

(58) Field of Classification Search
CPC ..... G07F 17/32
USPC ..... 463/15, 16, 25, 29, 35
See application file for complete search history.

(56) References Cited

U.S. PATENT DOCUMENTS 7,364,505 B2 4/2008 Mattice et al.
8,184,824 B2 * 5/2012 Hettinger et al. ..... 381/77
8,313,374 B2 * 11/2012 Loose ..... 463/31
8,360,841 B2 * 1/2013 Walker et al. ..... 463/16
8,932,137 B2 * 1/2015 Goldstein ..... G07F 17/32 463/42
2003/0130039 A1 * 7/2003 Nelson ..... G01S 5/02 463/42
2004/0053695 A1 * 3/2004 Mattice ..... G07F 17/3262 463/42
2004/0166932 A1 * 8/2004 Lam ..... G07F 17/3211 463/30
2005/0054440 A1 * 3/2005 Anderson ..... G07F 17/32 463/30
2005/0130732 A1 * 6/2005 Rothschild ..... G07F 17/32 463/20
2006/0217172 A1 * 9/2006 Roireau ..... G07F 17/32 463/16
2007/0006708 A1 * 1/2007 Laakso ..... G07F 17/32 84/1
2007/0077997 A1 * 4/2007 Johnson ..... G07F 17/32 463/42

(Continued)

FOREIGN PATENT DOCUMENTS

EP 1994970 11/2008
WO WO-2008057588 5/2008

(Continued)

*Primary Examiner* — Jason Skaarup
(74) *Attorney, Agent, or Firm* — DeLizio Law, PLLC

(57) ABSTRACT

A wagering game system and its operations are described herein. In embodiments, the operations can include detecting a trigger associated with a first wagering game machine. The trigger can be related to wagering game content or a wagering game event. A soundtrack is associated with the wagering game content or wagering game event. The operations can further include beginning play of the soundtrack in unison on the first wagering game machine at an audible volume level and on the second wagering game machine at an inaudible volume level in response to detecting the trigger.

21 Claims, 9 Drawing Sheets

(56) References Cited

U.S. PATENT DOCUMENTS

| | | | | |
|---|---|---|---|---|
| 2007/0111800 | A1* | 5/2007 | Tyndall | G07F 17/32 463/42 |
| 2008/0113708 | A1 | 5/2008 | Beadell et al. | |
| 2008/0113709 | A1 | 5/2008 | Beadell et al. | |
| 2008/0113715 | A1 | 5/2008 | Beadell et al. | |
| 2008/0113716 | A1 | 5/2008 | Beadell et al. | |
| 2008/0113741 | A1 | 5/2008 | Beadell et al. | |
| 2008/0113796 | A1 | 5/2008 | Beadell et al. | |
| 2008/0113821 | A1 | 5/2008 | Beadell et al. | |
| 2008/0161100 | A1 | 7/2008 | Mattice et al. | |
| 2008/0305857 | A1* | 12/2008 | Okada | 463/25 |
| 2009/0054156 | A1 | 2/2009 | Mori | |
| 2010/0248815 | A1* | 9/2010 | Radek | 463/25 |
| 2010/0261523 | A1* | 10/2010 | Bonney et al. | 463/25 |
| 2011/0092288 | A1* | 4/2011 | Pryzby | G07F 17/32 463/35 |
| 2011/0306416 | A1 | 12/2011 | Kelly et al. | |
| 2012/0115608 | A1* | 5/2012 | Pfeifer | G07F 17/3272 463/35 |
| 2012/0122554 | A1* | 5/2012 | Paquet et al. | 463/25 |

FOREIGN PATENT DOCUMENTS

| | | | |
|---|---|---|---|
| WO | WO-2008060431 | 5/2008 | |
| WO | WO-2008060492 | 5/2008 | |
| WO | WO-2008060953 | 5/2008 | |
| WO | WO-2008060960 | 5/2008 | |
| WO | WO-2008063410 | 5/2008 | |
| WO | WO-2008066686 | 6/2008 | |
| WO | WO 2009061466 A1 * | 5/2009 | G07F 17/32 |

* cited by examiner

SYNCHRONIZING SOUNDTRACKS ACROSS WAGERING GAME MACHINES

RELATED APPLICATIONS

This application claims the priority benefit of U.S. Provisional Application Ser. No. 61/429,322 filed Jan. 3, 2011.

LIMITED COPYRIGHT WAIVER

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2011, WMS Gaming, Inc.

TECHNICAL FIELD

Embodiments of the inventive subject matter relate generally to wagering game systems and networks that, more particularly, manage synchronization of soundtracks across wagering game machines.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

Soundtracks (e.g., an organized sequence of music, sound effects, voices, or other sounds) played in wagering games help to immerse a wagering game player ("player") into a wagering game experience and add to the excitement and fun of wagering games. The soundtrack for the wagering game is prepared and stored on the wagering game machine as part of a sound asset (e.g., a sound file) well before the wagering game machine is placed on the casino floor. After the casino receives the wagering game machine, the casino will often place the wagering game machine next to one or more wagering game machines that present the same wagering game(s). In other words, the casino will arrange like wagering game machines (e.g., wagering game machines of a similar theme) in a group, or bank, that are located in close proximity to each other. When one player starts one or more portions of the wagering game (e.g., when a player plays a first game credit for a primary wagering game, when a player enters a bonus round, etc.) on one of the wagering game machines in the bank, the wagering game begins playing the soundtrack associated with the one or more portions of the wagering game on its speakers at a starting point for the soundtrack (e.g., at a beginning of a musical score of the soundtrack). If another player starts playing the same wagering game, or portion of the wagering game, on a second, neighboring wagering game machine in the bank at a subsequent point in time, the second wagering game machine will start playing the same soundtrack from its speakers at the same starting point. However, because the second wagering game machine starts the soundtrack at a later point in time, the soundtrack played at the first wagering game machine will be staggered from the soundtrack played at the second wagering game machine. Because of the close proximity of the wagering game machines to each other in the bank, the staggered soundtracks may sound dissonant and distracting to each of the players.

BRIEF DESCRIPTION OF THE DRAWING(S)

Embodiments are illustrated in the Figures of the accompanying drawings in which.

DESCRIPTION OF ILLUSTRATIVE EMBODIMENTS

This description of the embodiments is divided into five sections. The first section provides an introduction to embodiments. The second section describes example operations performed by some embodiments. The third section describes additional example embodiments while the fourth section describes example operating environments. The fifth section presents some general comments.

Introduction

This section provides an introduction to some embodiments.

As mentioned previously, after a casino receives a wagering game machine the casino will often place the wagering game machine next to one or more other wagering game machines that present the same wagering game, forming a wagering game machine bank. The placement of the wagering game machines in close proximity to each other can cause identical soundtracks, started at different times, to sound staggered, dissonant and distracting to each of the neighboring players that are playing the wagering game machines and to other casino patrons.

Embodiments of the inventive subject matter, however, include examples of synchronizing the presentation of soundtracks on wagering game machines in a bank. Some embodiments include beginning play of multiple instances of a soundtrack on multiple wagering game machines in a bank at the same time from a common starting point when a first of the wagering game machines experiences a trigger that starts its instance of the soundtrack. The instance of the soundtrack on the first wagering game machine plays with sound. The other instances of the soundtrack for others of the multiple wagering game machines play without sound, or with imperceptible levels of volume, while the instance on the first wagering game machine plays with sound. Because all of the soundtracks began play at the same time from the common starting point, all of the soundtracks are in synchronization. When any other of the wagering game machines, such as a second wagering game machine, in the bank experiences a similar trigger, the sound for the instance of the soundtrack on the second wagering game machine is turned up, or increased, to a perceptible volume level (e.g., to a default volume level), and continues playing at a current point in the synchronized play of the instances of the soundtrack. In other words, the second wagering game machine does not re-start its instance of the soundtrack from the common starting point, it, instead, turns up the volume for its instance of the soundtrack.

Figure 1:
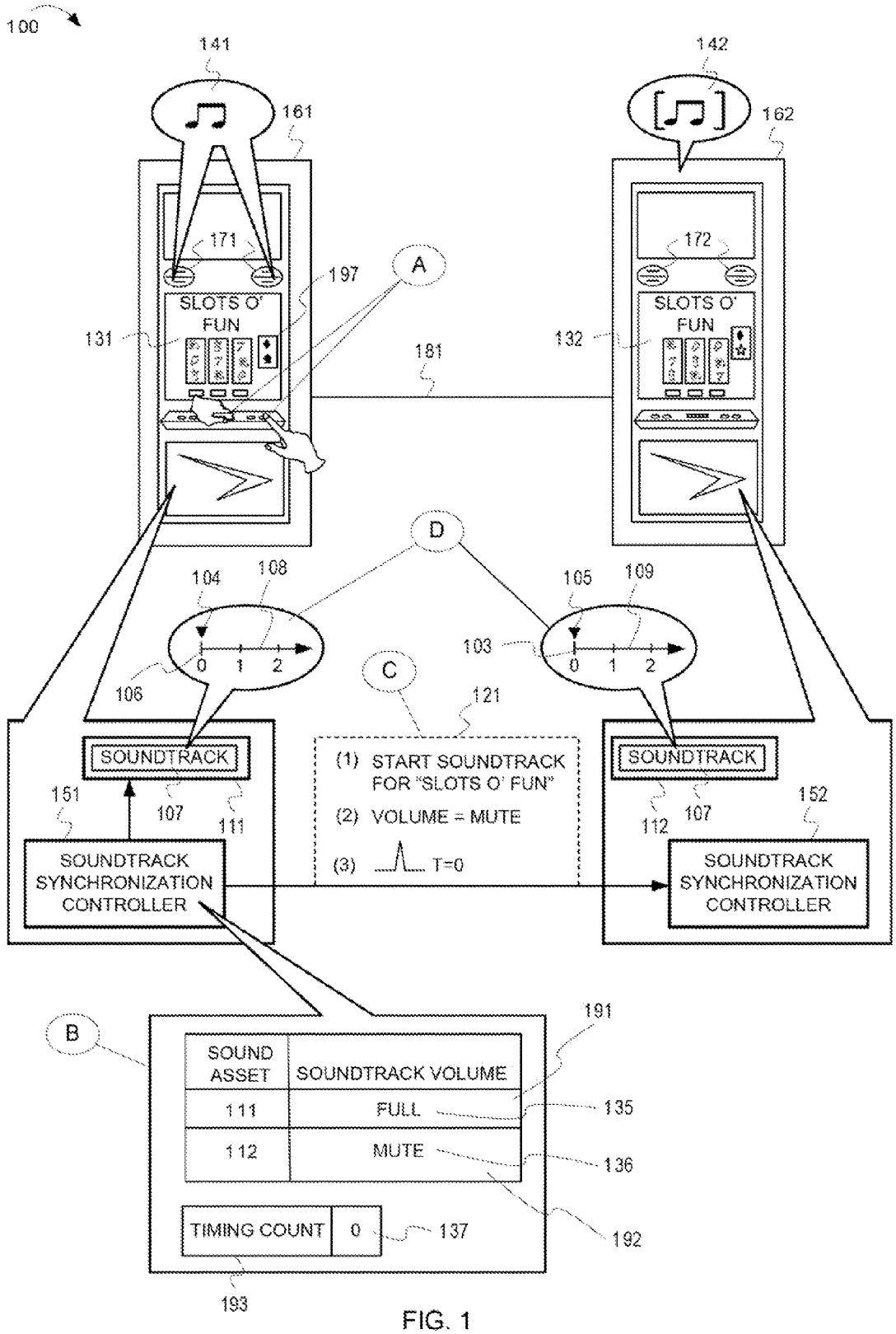
FIGS. 1-2 are illustrations of synchronizing soundtracks in a wagering game machine bank, according to some embodiments.
Figure 2:
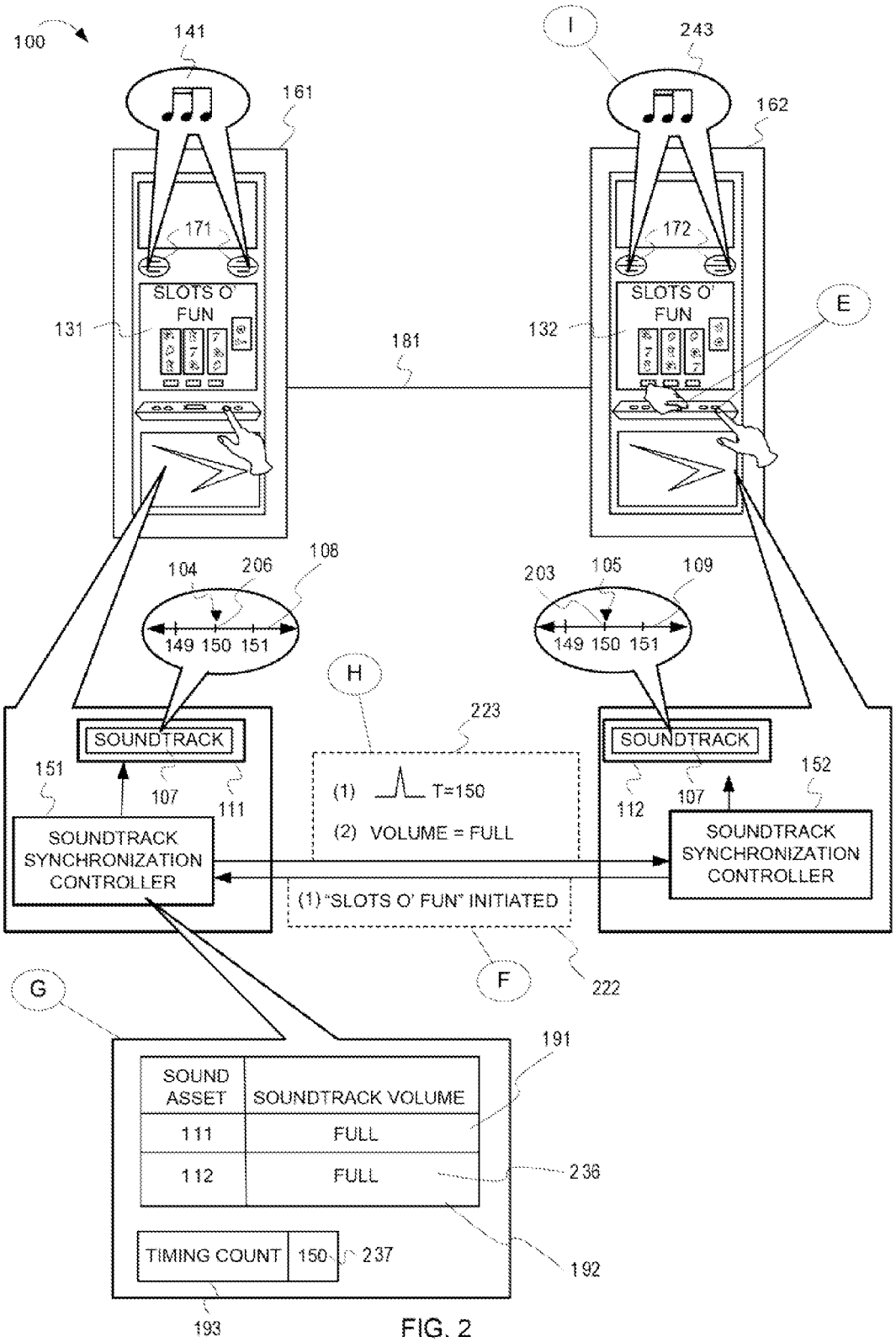

FIGS. 1-2 are illustrations of synchronizing soundtracks in a wagering game machine bank, according to some embodiments. In FIGS. 1 and 2, a wagering game system ("system") 100 includes wagering game machines 161 and 162 situated in a casino in a group or bank configuration (i.e., are grouped in close proximity to each other, are adjacent, etc.). Banks often contain more than two wagering game machines, however, for exemplary purposes, FIGS. 1 and 2 show only the two wagering game machines 161 and 162 in a bank configuration. The wagering game machines 161 and 162 are connected via a connection 181 (e.g., via a communications network, via a cable, via a wireless transmission system, etc.). Each of the wagering game machines 161 and 162 include soundtrack synchronization controllers 151 and 152. The wagering game machine 161 provides first wagering game content 131 and the wagering game machine 162 provides second wagering game content 132. In one instance, the first wagering game content 131 and the second wagering game content 132 are the same slot wagering game (e.g., the "Slots O' Fun" wagering game application). The first wagering game content 131 and the second wagering game content 132 include separate sound assets 111 and 112 that are configured to independently play separate instances of an identical, or substantially similar, soundtrack 107 depending on a triggering event that may occur independently on the wagering game machine 161 or the wagering game machine 162. The soundtrack 107 may be for the fictitious "Slots O' Fun" primary wagering game. In other embodiments, the soundtrack 107 may be for a bonus game or bonus round associated with the primary wagering game. In some embodiments, the soundtrack 107 may be for another secondary game application that runs independently from the primary wagering game. For example, the wagering game machines 161 and 162 may offer a variety of secondary wagering games via a secondary interface 197 incorporated into the wagering game machines 161 and 162. Regardless of the type of content that the instances of the soundtrack 107 are associated with, if similar content is capable of running independently on the wagering game machines 161 and 162, then the instances of the soundtrack 107, which are common between the similar content but initiated independently, can potentially be played in a staggered fashion, which may sound cacophonous. Stages "A" through "I" in FIGS. 1-2 describe synchronization of the instances of the soundtrack 107 in one example.

In FIG. 1, at stage "A," the soundtrack synchronization controller 151 detects that a trigger occurs, which indicates to start play of the instance of the soundtrack 107 associated with the sound asset 111. For instance, the soundtrack synchronization controller 151 detects that a player initiates play of the first wagering game content 131 on the wagering game machine 161. For instance, the player may log in to the wagering game machine 161 using a player tracking card. After logging in to the wagering game machine 161, and after detecting that the player account puts cash or credits onto the wagering game machine 161, the wagering game machine 161 enables wagering game play via the wagering game content 131. In another example, the trigger may be associated with a bonus game (e.g., a start of a bonus game) or other secondary content that presents the instances of the soundtrack 107 via the wagering game machine 161 and/or the wagering game machine 162. The wagering game machine 161 is configured to start playing the instance of the soundtrack 107 associated with the sound asset 111 in response to the trigger. The soundtrack synchronization controller 151 also determines that the wagering game machine 162 is configured to play a separate instance of the soundtrack 107 via the sound asset 112. However, the wagering game machine 162 does not experience the trigger that the wagering game machine 161 experienced (e.g., there is, at stage "B," no wagering game player logged in to the wagering game machine 162 or no initiation of a bonus game at the wagering game machine 162). Because the wagering game machine 162 is configured to play a separate instance of the same soundtrack 107, a second player could, at a future point in time, initiate the trigger on the wagering game machine 162 that would start playing the separate instance of the soundtrack 107 associated with the sound asset 112. At that future point in time, a sound of the instance of the soundtrack 107 via the sound asset 111, as produced by speakers 171 of the wagering game machine 161, would play simultaneously with a sound of the instance of the soundtrack 107 via the sound asset 112, as produced by speakers 172 of the wagering game machine 162. However, because each of the instances of the soundtrack 107 would have started at separate times, and because the wagering game machine 162 is located close to (e.g., within a specific proximity to the wagering game machine 161) the sounds of the instances of the soundtrack 107 may sound staggered and dissonant to any individual that is close to (e.g. within the specific proximity to) either the wagering game machine 161 or the wagering game machine 162.

Instead, at stage "B," the soundtrack synchronization controller 151 sets a first volume setting 191 and a second volume setting 192 associated, respectively, with the separate instances of the soundtrack 107 for the sound assets 111 and 112. The soundtrack synchronization controller 151 sets a first volume setting 191 for the sound asset 111 to a volume level 135 (e.g., to a full volume level) that will produce audible sound energy from the speakers 171. The soundtrack synchronization controller 151 also sets a second volume setting 192 for the sound asset 112 to a volume level 136 (e.g. to a muted volume level) that will produce little or no perceptible sound energy from the speakers 172. The soundtrack synchronization controller 151 can also produce a timing signal. The timing signal can pulse according to a consistent time measurement. In one embodiment, the time measurement is a time measurement for the instances of the soundtrack 107 (e.g., a time signature of the musical score associated with the soundtrack 107, a timing pattern for scheduled sound sample playback, etc.). The pulses for the time signal can be generated according to a clock associated with the wagering game machine 161. The soundtrack synchronization controller 151 tracks a pulse count for the timing signal via counter 193. A first value 137 for the pulse (e.g., count "0") can specify a first, or starting, pulse at which time both the sound asset 111 and the sound asset 112 will begin to play the instances of the soundtrack 107 in unison.

At stage "C," the soundtrack synchronization controller 151 sends data 121 to the soundtrack synchronization controller 152. The data 121 can include control instructions and other information that the soundtrack synchronization controller 152 can use to control the timing and volume settings for the sound asset 112. For instance, the data 121 includes an instruction to start the instance of the soundtrack 107 for the "Slots O' Fun" wagering game, at a muted volume. In some embodiments, the data 121 can include instructions to start the instance of the soundtrack for the sound asset 112 at the first time signal pulse (e.g., at pulse count "0").

At stage "D," the soundtrack synchronization controller 151 starts play of the instance of the soundtrack 107 for the sound asset 111 while at the same moment (e.g., at count "0") the soundtrack synchronization controller 151 (or the soundtrack synchronization controller 152) starts play of the instance of the soundtrack 107 for the sound asset 112. For example, the instance of the soundtrack 107 for the sound asset 111 includes a soundtrack timeline 108 with time markers that indicate points on the soundtrack timeline 108 that coincide with a playback time for the instance of the soundtrack 107 for the sound asset 111. The soundtrack synchronization controller 151 starts the instance of the soundtrack 107 for the sound asset 111 at a beginning time marker 106. A progression meter 104 above the beginning time marker 106 indicates the progression of the soundtrack 107 on the soundtrack timeline 108. At the same time, the soundtrack synchronization controller 152 also begins play of the instance of the soundtrack 107 for the sound asset 112 at a beginning time marker 103 and progresses along the soundtrack timeline 109 in unison with the instance of the soundtrack 107 for the sound asset 111 (i.e., the progression meter 104 and the progression meter 105 progress so that the soundtrack 107 is constantly at the same time marker points of the soundtrack timelines 108 and 109 for both the sound asset 111 and the sound asset 112 respectively). The speakers 171 produce the audio field 141A which presents the music and/or other audio effects as the instance of the soundtrack 107 for the sound asset 111 progresses its play along the soundtrack timeline 108. The speakers 172, however, do not produce an audio field. Instead the soundtrack synchronization controller 152 in the wagering game machine 162 plays the instance of the soundtrack 107 for the sound asset 112 in an inaudible (e.g., muted) state 142A. In some embodiments, instead of not playing sound from the speakers 172, the sound volume can play sound from the speakers 172, but at a volume level that is low enough that an individual at or around the wagering game machine 162 would not be able to hear the sound of the instance of the soundtrack 107 from the speakers 172 over the audio field 141A or other background noise in the casino. The soundtrack synchronization controller 151 can also continue to generate and send timing signal pulses to the soundtrack synchronization controller 152 while the wagering game content 131 is presented and used at the wagering game machine 161 and while the wagering game machine 162 is not being used to play the wagering game content 132 that would present the instance of the soundtrack 107 for the sound asset 112.

Continuing on to FIG. 2, at stage "E," the soundtrack synchronization controller 152 detects that the wagering game machine 162 experiences a trigger (e.g., a login procedure and/or an activation of wagering game play) that indicates that the wagering game content 132 should begin playing the instance of the soundtrack 107 for the sound asset 112.

At stage "F," the soundtrack synchronization controller 152 sends data 222, which indicates that the wagering game content 132 (e.g., the "Slots O' Fun" slot wagering game) was activated and should begin playing the instance of the soundtrack 107 for the sound asset 112.

At stage "G," the soundtrack synchronization controller 151 receives the data 222 and modifies the sound volume setting 192 to have a new volume level 236 that is audible (e.g., a "full" volume level). The soundtrack synchronization controller also checks the counter 193 and determines that the timing signal count is a value 237 of "150" pulses.

At stage "H," the soundtrack synchronization controller 151 sends data 223 that indicates the updated volume level value 236. In some embodiments, the data 223 can also indicate the timing signal pulse for the count of "150."

At stage "I," the soundtrack synchronization controller 151 (or the soundtrack synchronization controller 152) updates the volume level on the wagering game machine 162 so that the speakers 172 produce a volume level that is audible (e.g., the "full" volume level). Because the instance of the soundtrack 107 for the sound asset 112 has been playing in synchronicity with the instance of the soundtrack 107 for the sound asset 111, then when the volume level is updated for the instance of the soundtrack 107 for the sound asset 112, the speakers 172 generate an audio field 243 that is identical, or at least substantially similar, to the audio field 141. In other words, the instances of the soundtracks 107 are in unison. For example, the progression meters 104 and 105 are simultaneously at time markers 206 and 203, which are the same point in the soundtrack 107. The time markers 206 and 203 can also coincide with a progression count of "150," which corresponds to the timing pulse count of "150" The soundtrack synchronization controller 152 can also utilize the updated count value 237 (e.g., the count of "150") to correct any possible timing variance or drift that may have occurred to the instance of the soundtrack 107 for the sound asset 112 since the beginning of the unison playback of the instances of the soundtrack 107 (e.g., since the pulse at the count of "0"). For instance, if the progression meter 105 is slightly behind or ahead of the progression meter 104 at timing count "150", the soundtrack synchronization controller 151 or 152 can adjust the progression meter 105 to speed up or slow down to be in synchronization with the progression meter 104. The updated count value 237, thus, can be used to ensure that the instance of the soundtrack 107 for the sound asset 112 is completely in synchronization with the instance of the soundtrack 107 for the sound asset 111. In some embodiments, the soundtrack synchronization controller 152 can also correct drift during any previous instance(s) of the timing signal pulse from the soundtrack synchronization controller 151. In some embodiments, the system 100 uses a timing signal pulse that is short enough in duration that drift can be corrected without an audibly noticeable change between the instances of the soundtrack 107 (e.g., correct drift at approximately every 25 milliseconds). In other embodiments, the system 100 can track a degree of drift and only correct when the drift is large enough that it would be audibly distinguishable (e.g., if the timing of the play of the instances of the soundtracks is within 25 milliseconds, then no drift correction is made).

One should note that the system 100 can play multiple soundtracks for multiple wagering games concurrently. For instance, the soundtrack synchronization controller 151 can concurrently track and control soundtrack synchronization for a primary wagering game, a secondary wagering game, a community wagering game, or any other content that is capable of being presented concurrently on the wagering game machines 161 and 162.

Embodiments can be presented over any type of communications network that provides access to wagering games, such as a public network (e.g., a public wide-area-network, such as the Internet), a private network (e.g., a private local-area-network gaming network), a file sharing network, a social network, etc., or any combination of networks. Multiple users can be connected to the networks via computing devices. The multiple users can have accounts that subscribe to specific services, such as account-based wagering systems (e.g., account-based wagering game websites, account-based casino networks, etc.).

Further, in some embodiments herein a user may be referred to as a player (i.e., of wagering games), and a player may be referred to interchangeably as a player account. Account-based wagering systems utilize player accounts when transacting and performing activities, at the computer level, that are initiated by players. Therefore, a "player account" represents the player at a computerized level. The player account can perform actions via computerized instructions. For example, in some embodiments, a player account may be referred to as performing an action, controlling an item, communicating information, etc. Although a player, or person, may be activating a game control or device to perform the action, control the item, communicate the information, etc., the player account, at the computer level, can be associated with the player, and therefore any actions associated with the player can also be associated with the player account. Therefore, for brevity, to avoid having to describe the interconnection between player and player account in every instance, a "player account" may be referred to herein in either context. Further, in some embodiments herein, the word "gaming" is used interchangeably with "gambling."

Although FIGS. 1 and 2 describes some embodiments, the following sections describe many other features and embodiments.

Example Operations

This section describes operations associated with some embodiments. In the discussion below, some flow diagrams are described with reference to block diagrams presented herein. However, in some embodiments, the operations can be performed by logic not described in the block diagrams.

In certain embodiments, the operations can be performed by executing instructions residing on machine-readable storage media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform more or less than all the operations shown in any flow diagram.

Figure 3:
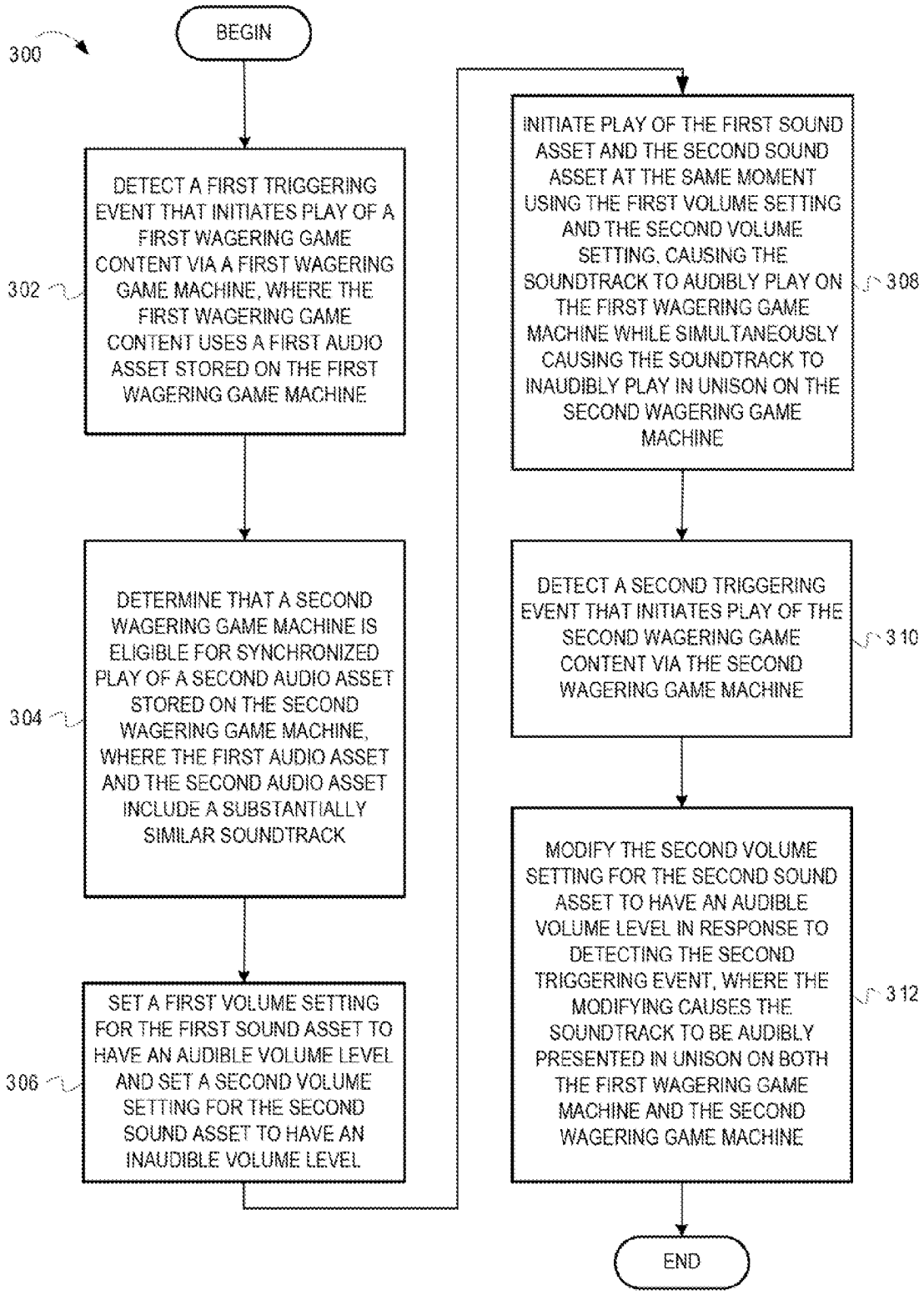
FIG. 3 is a flow diagram 300 illustrating synchronizing soundtracks in a wagering game machine bank, according to some embodiments.

FIG. 3 is a flow diagram ("flow") 300 illustrating synchronizing soundtracks in a wagering game machine bank, according to some embodiments. In FIG. 3, the flow 300 begins at processing block 302, where a wagering game system ("system") detects a first triggering event that initiates play of a first wagering game content via a first wagering game machine, where the first wagering game content uses a first audio asset stored on the first wagering game machine. FIG. 1 above illustrated an example.

The flow 300 continues at processing block 304, where the system determines that a second wagering game machine is eligible for synchronized play of a second audio asset stored on the second wagering game machine, where the first audio asset and the second audio asset include a substantially similar soundtrack.

The flow 300 continues at processing block 306, where the system sets a first volume setting for the first sound asset to have an audible volume level and sets a second volume setting for the second sound asset to have an inaudible volume level. The inaudible volume level may be a muted volume value or "0" volume value.

The flow 300 continues at processing block 308, where the system initiates play of the first sound asset and the second sound asset at the same moment using the first volume setting and the second volume setting, causing the soundtrack to audibly play on the first wagering game machine while simultaneously causing the soundtrack to inaudibly play in unison on the second wagering game machine The flow 300 continues at processing block 310, where the system detects a second triggering event that initiates play of the second wagering game content via the second wagering game machine.

The flow 300 continues at processing block 312, where the system modifies the second volume setting for the second sound asset to have an audible volume level in response to detecting the second triggering event, where the modifying causes the soundtrack to be audibly presented in unison on both the first wagering game machine and the second wagering game machine. For example, the system can un-mute the second volume setting for the second sound asset in response to detecting the second triggering event. The un-muting causes sound to be produced for the soundtrack on the second wagering game machine, and the soundtrack plays in unison, with sound, on first speakers associated with the first wagering game machine and on second speakers associated with the second wagering game machine.

Figure 4:
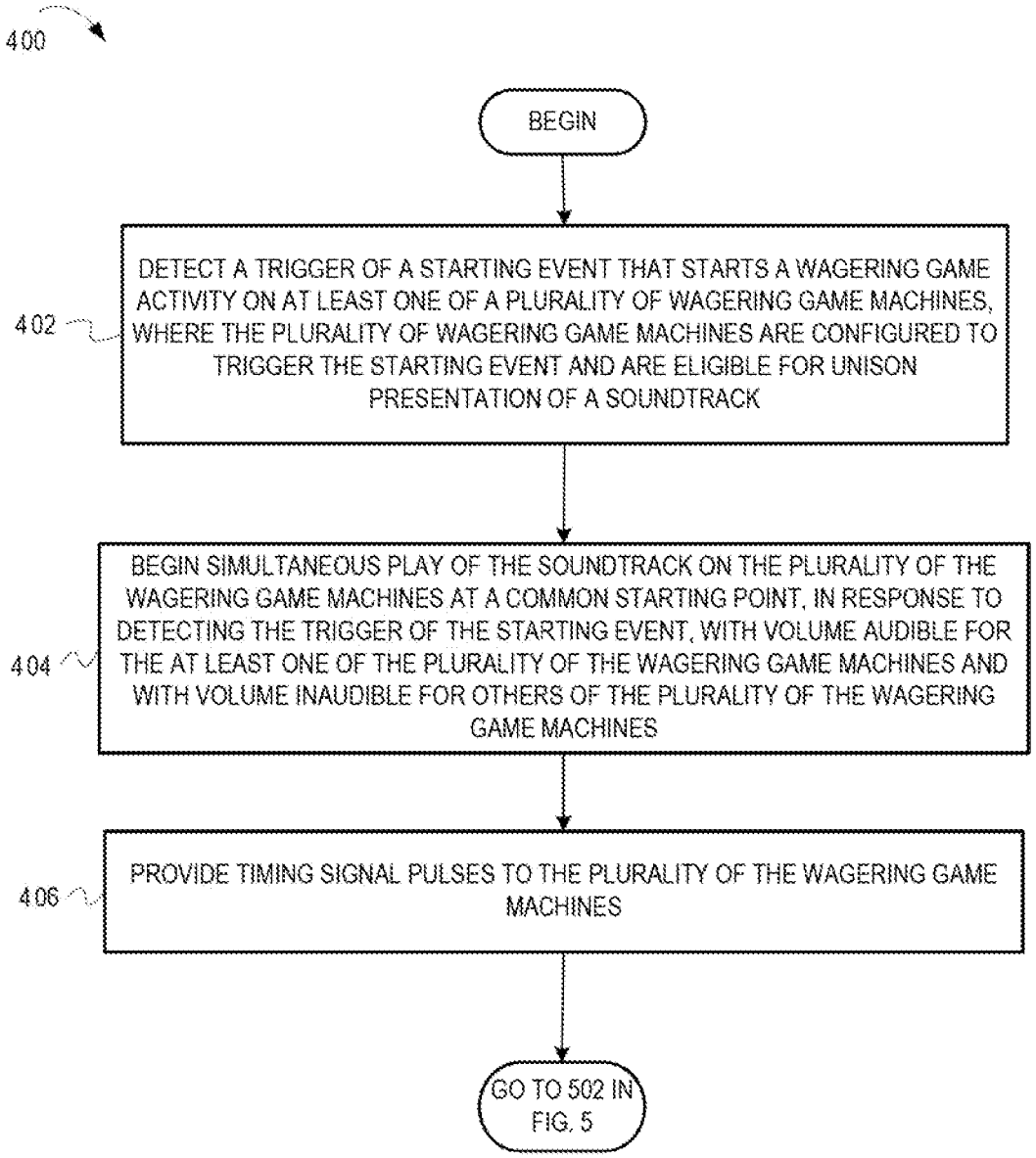
FIGS. 4-5 are a flow diagram 400 illustrating synchronizing soundtracks in a wagering game machine bank, according to some embodiments.
Figure 5:
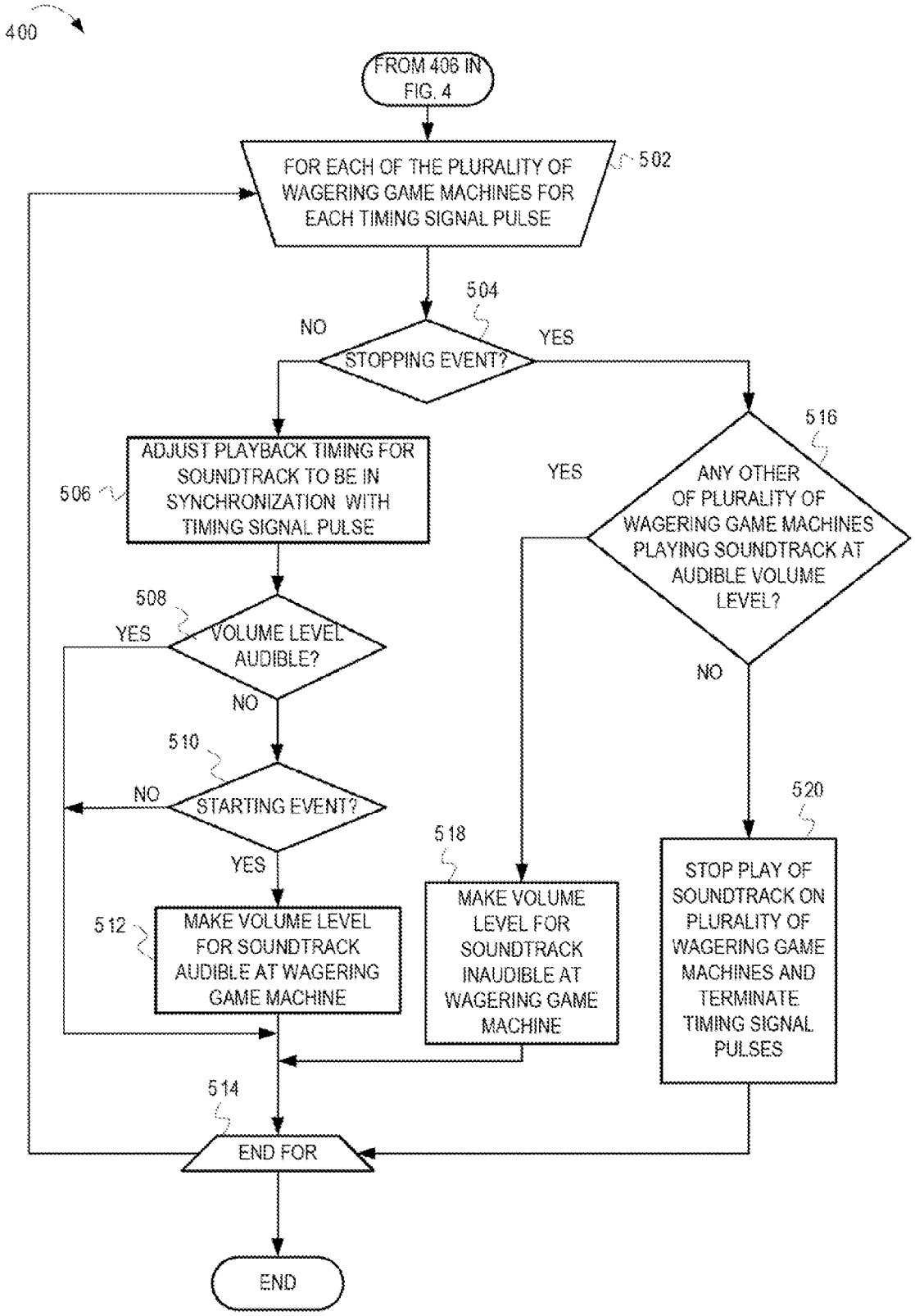

FIGS. 4-5 are a flow diagram ("flow") 400 illustrating synchronizing soundtracks in a wagering game machine bank, according to some embodiments. In FIG. 4, the flow 400 begins at processing block 402 where a wagering game system ("system") detects a trigger of a starting event that start a wagering game activity on at least one of a plurality of wagering game machines, where the plurality of wagering game machines are configured to trigger the starting event and are eligible for unison presentation of a soundtrack. In some embodiments, the system can determine that the plurality of the wagering game machines are configured to trigger the starting event by detecting that a specific wagering game activity is available at (e.g., stored on), or can possibly be performed at the each of the wagering game machines (e.g., each of the plurality of the wagering game machines are the same theme and/or store the same wagering game application, each of the plurality of the wagering game machines are multi-game wagering game machines that provide the wagering game, each of the plurality of the wagering game machines provides an instance of a wagering game machine as a server-side game, etc.). In some embodiments, the system can determine that the plurality of the wagering game machines are eligible for unison presentation of a soundtrack by determining that the plurality of the wagering game machines are associated with each other by location. For example, the system can detect that the plurality of the wagering game machines are in close proximity (e.g., with a pre-specified distance, within a set geographic location on a casino floor, within a degree of geographical locators, etc.) or otherwise oriented (e.g., are facing the same direction) in a way where the soundtracks may conflict and sound dissonant if played in a staggered manner. In some embodiments, the system can determine that the plurality of the wagering game machines are eligible for unison presentation of a soundtrack by determining that the plurality of the wagering game machines are associated with each other by linked accounts. For example, the system can capture or record concurrent wagering game play by two or more players who have an association via their accounts (e.g., friends, social contacts, etc.) or for multiple players playing a group game at a wagering game machine bank. The system can, at some point, playback, or re-play, the recordings of the concurrent wagering game play. During playback, the soundtracks would be in unison (e.g., during playback on an overhead panel of multiple games).

The flow 400 continues at processing block 406 where the system begins simultaneous play of the soundtrack on the plurality of the wagering game machines at a common starting point, in response to detecting the trigger of the starting event, with volume audible for the at least one of the plurality of the wagering game machines and with volume inaudible for others of the plurality of the wagering game machines. Audible volume can be un-muted volume or a volume level that a human ear can perceive relative to the surroundings. Inaudible volume can be muted volume or a volume level that a human ear cannot perceive relative to the surroundings. In some embodiments the system can measure a volume level of sound at any of the wagering game machines to determine an audible versus inaudible sound level. In other embodiments, the system merely sets volume levels to "0" volume levels, or "muted" levels without measuring volume levels.

The flow 400 continues at processing block 408 where the system provides timing signal pulses to the plurality of the wagering game machines. In some embodiments, the one of plurality of the wagering game machines generates the timing signal and controls synchronicity of a common soundtrack, as described in FIG. 1. In another example, a wagering server or other device having a clock generates the timing signal (e.g., see the gaming environment controller in FIG. 6). In some embodiments, the system generates the timing signal pulses in synchronicity with a clock on one of the plurality of the wagering game machines. In some embodiments, the system generates the timing signal pulses to coincide with a start of a timing beat (e.g., bar line, start of a measure, digital file marker, etc.) that marks a segment of time defined by a given number of units (e.g., beats, markers, samples, etc.) of a given duration, position, etc., in the soundtrack.

The flow 400 continues in FIG. 5, at processing block 502 where the system performs a loop ("the loop") for each of the plurality of wagering game machines for each timing signal pulse. This description will refer to the wagering game machine that is subject to the current iteration of the loop as the "subject" wagering game machine.

The flow 400 continues at processing block 504 where the system determines whether a stopping event occurs on the subject wagering game machine. In other words, the system determines whether an event occurs that triggers the stop of the wagering game activity on the subject wagering game machine. The stopping event indicates that the soundtrack should stop being audibly presented on the subject wagering game machine (e.g., a wagering game ends, a wagering game session ends, a player cashes out, a player tracking card is removed from a wagering game machine, etc). During the first iteration of the loop, only the at least one of the plurality of wagering game machines referred to at processing blocks 402 and 404 will already have experienced a starting event. However, the loop repeats for each timing signal pulse, and, therefore, on subsequent repetitions of the loop others of the wagering game machines may have experienced a starting event.

If the system does not detect a stopping event at processing block 504, then the flow 400 continues at processing block 506 where the system adjusts playback timing for the soundtrack, at the subject wagering game machine, to be in synchronization with the timing signal pulse.

The flow 400 continues at processing block 508 where the system determines whether the volume level for the soundtrack at the subject wagering game machine is audible. For instance, if the loop is at an iteration associated with the at least one of the plurality of the wagering game machines that was set at an audible volume level at processing block 404, then, at processing block 508, the system will detect an audible volume level. The flow 400 will then continue at processing block 514. If, however, the loop is at an iteration associated with one of the others of the plurality of the wagering game machines that was set at an inaudible volume level, then the system will detect an inaudible volume level. The flow 400 will then continue at processing block 510 where the system determines whether a starting event has occurred for the subject wagering game machine. If the subject wagering game machine has not yet experienced a starting event (e.g., the wagering game machine 162 in FIG. 1, which has not yet experienced the event described at stage "E," in FIG. 2), then the flow 400 continues at processing block 514. If, however, the system detects that the subject wagering game machine has experienced the starting event, then the flow 400 continues at processing block 512 where the system makes the volume level for the soundtrack audible at the subject wagering game machine.

If the system does detect a stopping event at processing block 504, then the flow 400 continues at processing block 516 where the system determines whether any other ones of the plurality of the wagering game machines that are not the subject wagering game machine are currently playing the soundtrack at an audible volume level. If, at processing block 516, the system determines that at least one other of the plurality of the wagering game machines that is not the subject wagering game machine is playing the soundtrack at an audible volume level, then the flow 400 continues at processing block 518, where the system makes the volume level for the soundtrack inaudible at the subject wagering game machine. In some embodiments, if the subject wagering game machine is controlling the timing signal pulse, the system can transfer control of the timing signal pulse from the subject wagering game machine to any one of the plurality of the wagering game machines that are audibly playing the soundtrack (e.g., any of the plurality of the wagering game machines that are playing the wagering game activity).

In some embodiments, the stopping event may delay the audible sound of the wagering game activity for a specific period of time while still playing the soundtrack on the subject wagering game machine. Thus, on subsequent iterations of the loop, the system can detect, at processing block 510, whether a starting event occurs for the subject wagering game machine that will re-trigger the audible presentation of the soundtrack on the subject wagering game machine. For instance, if the subject wagering game machine begins a second wagering game activity that is temporary but that uses a second soundtrack (e.g., a bonus round, a group wagering game, etc.) the soundtrack for the first wagering game activity ("first soundtrack") would not need to play, and could be made temporarily inaudible. The system, however, would continue to play the first soundtrack on the subject wagering game machine in the inaudible state while the second soundtrack plays audibly on the subject wagering game machine. The system can recognize the end of the second wagering game activity during the loop (e.g., at processing block 510), which triggers the re-starting of the first wagering game activity (i.e., the end of the second wagering game activity triggers a starting event), and at processing block 512, the system makes the volume level for the first soundtrack audible again. While the second soundtrack plays, the system, at each iteration of the loop for the subject wagering game machine, can adjust the playback timing for the soundtrack, at processing block 506, using the timing signal.

If the system determines, at processing block 516, that no other ones of the plurality of the wagering game machines other than the subject wagering game machine is currently playing the soundtrack at an audible volume level, the flow continues at processing block 520, wherein the system stops play of the soundtrack on the plurality of the wagering game machines. Also at processing block 520, the system terminates the timing signal pulse.

At processing block 514 the system determines whether the loop has ended. For example, if the system terminates the timing signal pulses at processing block 520, then the loop will end, and the flow will end. If, however, the system does not terminate the timing signal pulses, the loop will return to processing block 502.

Additional Example Embodiments

According to some embodiments, a wagering game system ("system") can provide various example devices, operations, etc., to synchronize soundtracks across wagering game machines. The following non-exhaustive list enumerates some possible embodiments.

Server Based Soundtrack Synchronization.

Figure 6:
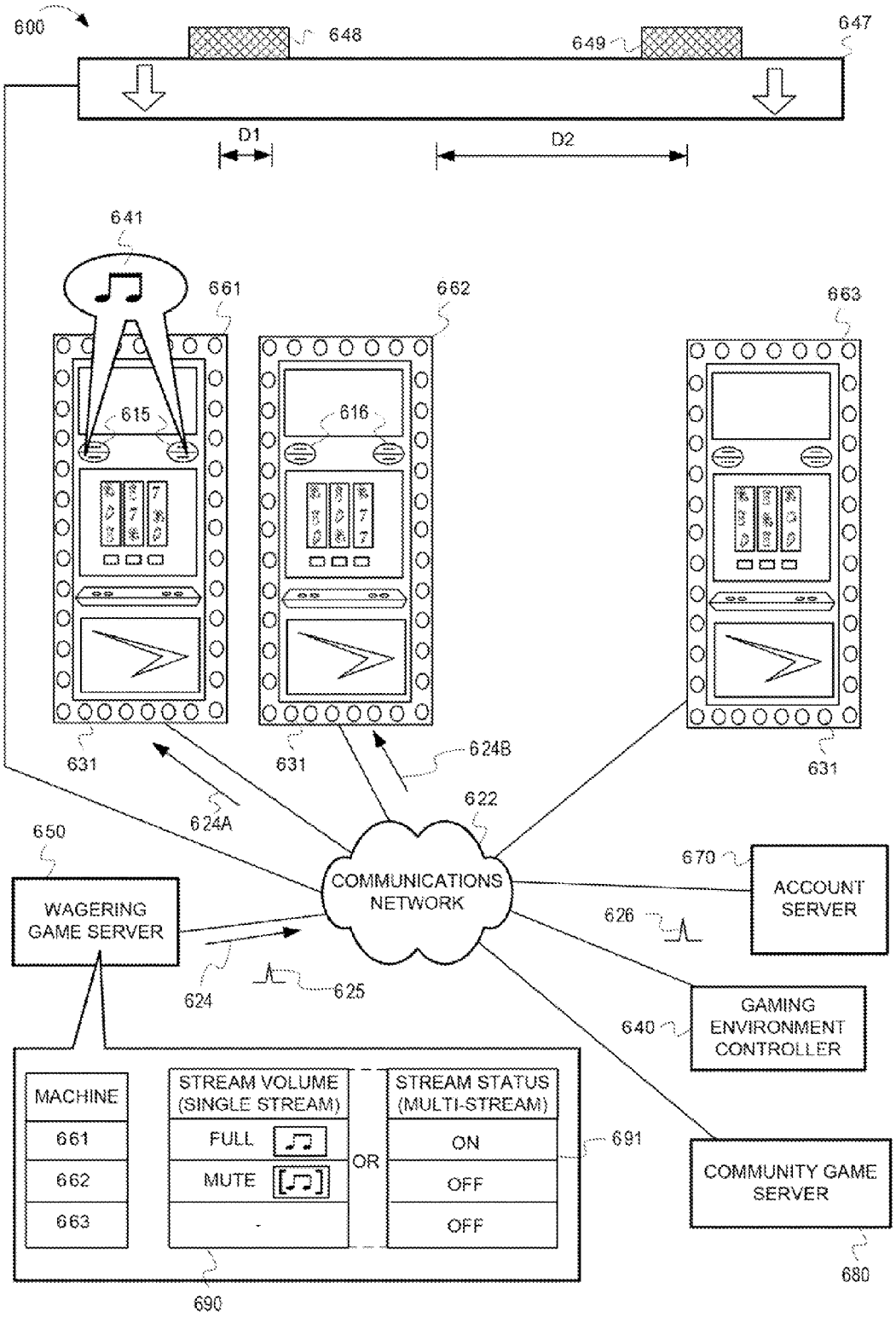
FIG. 6 is an illustration of a wagering game system 600, according to some embodiments.

In some embodiments, the system can stream a soundtrack to eligible wagering game machines. FIG. 6 illustrates an example. In FIG. 6, a wagering game system ("system") 600 includes wagering game machines 661, 662, and 663 ("661-663"). Wagering game machines 661 and 662 are situated in a casino in a group or bank (i.e., are grouped in close proximity to each other, are adjacent, etc.). The wagering game machines 661-663 are connected to a communications network 622. A wagering game server 650, a community game server 680, and a gaming environment controller 640 are also connected to the communications network 622. Also included in the system 600 is an account server 670. The account server 670 host can host multiple wagering game accounts. Players log in to the wagering game machines 661-663 using the player accounts (e.g., players use player tracking cards to login to any one of the wagering game machines 661-663 using magnetic card readers, radio frequency readers, etc., at the wagering game machines 661-663). The wagering game machines 661-663, the wagering game server 650, the community game server 680 and/or the gaming environment controller 640 can provide some gaming content (e.g., a primary game, a secondary game, reels, payline meters, bet meters, credit meters, reel control buttons, etc.) during wagering game sessions. Players can play gaming content during the wagering game sessions on any of the wagering game machines 661-663. The wagering game server 650 and/or the account server 670 interact during the wagering game sessions to transfer bets or wagers between any of the player accounts and a casino account. The community game server 680 can, at some point during the wagering game sessions, present a community gaming event for any of the player accounts that may be eligible to participate in and/or receive a presentation of the community gaming event. For instance, during the wagering game sessions, any of the players can contribute a portion of bets to be eligible for a community jackpot or a community bonus game. The account server 670 can track which of the player accounts are eligible. For example, the player accounts may have performed activities during primary wagering game play, or been selected for other reasons to participate in the community event. In some embodiments, the wagering game server 650 can provides content for the community event. In some embodiments, the wagering game server 650 can also provide server based content that is not a community game. Part of the content from the wagering game server 650 may include a sound or lighting effect that is scheduled to play on the wagering game machines 661-663 simultaneously.

In some embodiments, the wagering game server 650 detects that the wagering game machine 661 initiates play of wagering game content that uses a soundtrack. The wagering game server 650 may further determine that the wagering game machines 662 and 663 are capable, at some point, of initiating play of a common soundtrack associated with the wagering game content. The wagering game server 650 can further detect a first distance (D1) to the wagering game machine 662 and a second distance (D2) between the wagering game machine 662 and the wagering game machine 663. Based on the distances D1 and D2, the wagering game machine 650 determines that the wagering game machine 662 is close enough to the wagering game machine 661 that a staggered soundtrack presentation may be audibly distracting and dissonant. At the same time, the wagering game server 650 determines that the wagering game machine 663 is far enough away from the bank (e.g., from the wagering game machine 662, which may mark an end of the bank or a gap in the bank) that a staggered soundtrack presentation may not be audibly distracting or dissonant. The wagering game server 650, therefore, can determine that the wagering game machines 661 and 662 are eligible for unison playback of the soundtrack, but wagering game machine 663 is not eligible for unison playback of the soundtrack.

The wagering game server 650 can implement unison playback of a soundtrack in multiple ways. For instance, in one embodiment, the wagering game server 650 can broadcast separate streams of data 624A and 624B via separate communication channels to the wagering game machines 661 and 662 and modify volume settings for each of the separate streams of data 624A and 624B (e.g., modify volume settings 690 so that wagering game machine 661 receives the stream 624A at full volume and wagering game machine 662 receives the stream 624B at a muted volume level). Thus, in one embodiment, the wagering game machine 661 receives data for the soundtrack and presents an audio field 641 that plays an audible sound from the speakers 615 for the soundtrack, while at the same time the wagering game machine 662 receives data for the soundtrack, but does not produce an audible sound from the speakers 616.

In another embodiment, the wagering game server 650 can broadcast a single data stream 624 and open a port, or channel, when one of the wagering game machines 661 or 662 experience a triggering event.

In some embodiments, the wagering game server 650 does not provide the soundtrack in the data stream 624, but instead provides instructions via the data stream 624 to play sound assets on the wagering game machines 661 and 662. The wagering game server 650 can also provide a timing signal 625 that the wagering game machines 661 and 662 use to adjust the timing of the soundtrack presentation and keep the presentation of the soundtrack on the wagering game machines 661 and 662 in synchronization. In some embodiments, the wagering game server 650 uses a timing signal provided by the gaming environment controller 640. The gaming environment controller 640 controls presentation of lighting and sound effects via the speakers 615, 616, and 617, as well as from emotive lighting 631, overhead lighting 647, and from overhead speakers 646 and 649. The gaming environment controller 640 may utilize a timing signal 626 to keep all of the gaming effects in synchronization. The wagering game server 650 can utilize the timing signal 626 from the gaming environment controller 640 instead of, or in addition to, the timing signal 625, to modify the presentation of soundtracks via separate sound assets stored on the wagering game machines 661 and 662. In some embodiments, the gaming environment controller 640 can communicate emotive lighting data between wagering games and components of a wagering game machine (e.g., a central processing unit "CPU", an emotive light controller "ELC", and emotive lighting device, etc.) via a Universal Serial Bus (USB) connection. In some embodiments, the system can communicate emotive lighting data in a bank via a peer-to-peer communication network (e.g., Emotive Lighting Synchronization Network, or EL Sync). In some embodiments, the system can communicate emotive lighting data between network lighting controllers and wagering game machines via a DMX512 (DMX) network. In some embodiments, exemplary sources of emotive lighting data can include (1) a wagering game on a wagering game machine, (2) a neighboring wagering game machine as part of a synchronized peer-to-peer emotive lighting network within a machine bank, (3) a casino level lighting network (e.g., DMX controller), and (4) other localized and network sources vying for use of emotive light devices on a wagering game machine such as a centralized controller or server that provides secondary wagering games. In some embodiments the secondary games can communicate directly with an emotive light controller (ELC) associated with a wagering game machine or with primary wagering games on the wagering game machine via an environmental lighting controller (e.g., DMX controller).

In some embodiments, the wagering game server 650 can concurrently stream data for various types and numbers of content including for primary wagering games, bonus games, group or community games, casino-wide events, etc., and can synchronize soundtracks for all of the content concurrently.

Smart Muting.

In some embodiments, the system can determine that a wagering game machine at a bank is eligible for unison playback (i.e., synchronized soundtrack play) at some times but at others is not eligible. For instance, in FIG. 1, the wagering game machines 161 and 162 may be separated by several other ("intervening") wagering game machines at the bank. If no players are situated at the intervening wagering game machines the system may decide to not make the wagering game machine 162 eligible to receive unison playback. The system can also take into consideration factors such as a time or date. For instance, if a casino is in a slow period where there is little chance of players occupying neighboring wagering game machines at a bank, then the system may decide to not implement unison playback or synchronization of soundtracks.

Common Soundtrack Effects.

Some embodiments above referred to playing music associated with a soundtrack. In other embodiments soundtracks may play sound effects, ambience sounds, voices, etc. in addition to, or instead of, music. Thus, soundtracks may include, but are not limited to musical scores.

Marker Coordination.

In some embodiments, the system specifies a marker, or indicator, that identifies a specific point in a soundtrack file to start playing a soundtrack. For example, a first wagering game machine starts playing a first instance of a soundtrack at a starting time but does not initiate unison playback of a second instance of the soundtrack at a second, neighboring wagering game machine in a bank. Later, the second wagering game machine experiences a trigger that indicates to play the second instance of the same soundtrack. A first soundtrack synchronization controller for the first wagering game machine can detect that the second wagering game machine experienced the trigger and can provide to the second wagering game machine a marker indicator that specifies an exact location for the first instance of the soundtrack that the first wagering game machine is playing (e.g., an exact location within a first sound asset or file that the first instance of the soundtrack has reached since the starting time). A second soundtrack synchronization controller for the second wagering game machine can receive the marker indicator and begin playing the second instance of the soundtrack at the exact same location of the second instance of the soundtrack for the second wagering game machine (e.g., start playing the second instance of the soundtrack at the exact location within a second sound asset or file that the first sound asset or file has reached since the starting time).

Multi-Channel Sound Synchronization.

In some embodiments, the system can utilize a multi-channel file where one or more of the channels is dedicated to the sound content of the soundtrack (e.g., the music, audio, voices, sound effects, etc.) and at least one of the channels is dedicated to time codes. The time codes include a time stamp that can be used to generate timing signals.

Bonus Game Synchronization.

In some embodiments, a trigger that initiates play of a soundtrack may be a bonus game. Bonus game content may be stored on a wagering game machine and/or stored on a wagering game server. For instance, a wagering game server provides a variety of bonus games for any given primary game. The bonus games can be different themes from a theme for a primary wagering game. In some embodiments, a player can select the bonus game from a listing of bonus games for which the player is eligible (e.g., has qualified to play, is registered to play, etc.). In some embodiments, the system can present a bonus game on a first wagering game machine. The system can also determine whether a second wagering game machine is eligible to present the bonus game (e.g., whether the second wagering game machine is in proximity to the first wagering game machine, whether a player logged on to the second wagering game machine is eligible to play the bonus game, some combination, etc.). If the second wagering game machine is eligible to present the bonus game, the system can begin simultaneous, unison, play of the bonus game's soundtrack on both the first wagering game machine and the second wagering game machine, with the first wagering game machine playing the soundtrack at an audible volume level and with the second wagering game machine playing the soundtrack at an inaudible volume level. In some embodiments, if the second wagering game machine experiences a trigger that initiates play of the bonus game while the first wagering game machine is playing the bonus game, the system can cause the second wagering game machine to increase the volume level to be audible via the second wagering game machine. Thus, the soundtrack would be in unison on both the first wagering game machine and the second wagering game machine. When the first wagering game machine begins audible play, the system may analyze whether any additional wagering game machines may be eligible because of their relationship (e.g., proximity to) the second wagering game machine and begin simultaneous, unison play on the additional wagering game machines with inaudible volume levels on the additional wagering game machines. In some embodiments, the system may continuously play a soundtrack.

Continuous Soundtrack Broadcasting Via a Channel.

In some embodiments, the system can play a continuously looping instance of a soundtrack on a network channel and broadcast the continuously looping soundtrack, via the network channel, to any wagering game machine that triggers play of the soundtrack. The wagering game machine can subscribe a sound server that broadcasts the network channel. When the wagering game machine triggers the event that would initiate play of the soundtrack (e.g., for a primary game, a secondary game, etc.), the system tunes into the network channel that loops the soundtrack. The wagering game machine plays the broadcast of the continuously looping instance of the soundtrack from the point at which the soundtrack is playing in its loop on the network channel. Any wagering game machine that tunes into the channel will play the instance of the soundtrack from its current point in its loop on the network channel. Thus, the system can ensure that any wagering game machine would play the soundtrack in unison with any other wagering game machine regardless of when the wagering game machines triggered play of the soundtrack. The system can broadcast multiple network channels where each network channel is dedicated to a soundtrack for a distinct content (e.g., a distinct game theme, a distinct game type, etc.). Each network channel can have a different channel identifier, and a wagering game machine can tune into any given channel by selecting the channel identifier similar to tuning into a channel on a radio. In some embodiments, a wagering game machine can tune into a network channel and automatically adjust the volume of the network channel as presented at the wagering game machine based on various factors, such as whether the wagering game machine has paused the presentation of the content.

Example Operating Environments

This section describes example operating environments, systems, and networks and presents structural aspects of some embodiments.

Wagering Game System Architecture

Figure 7:
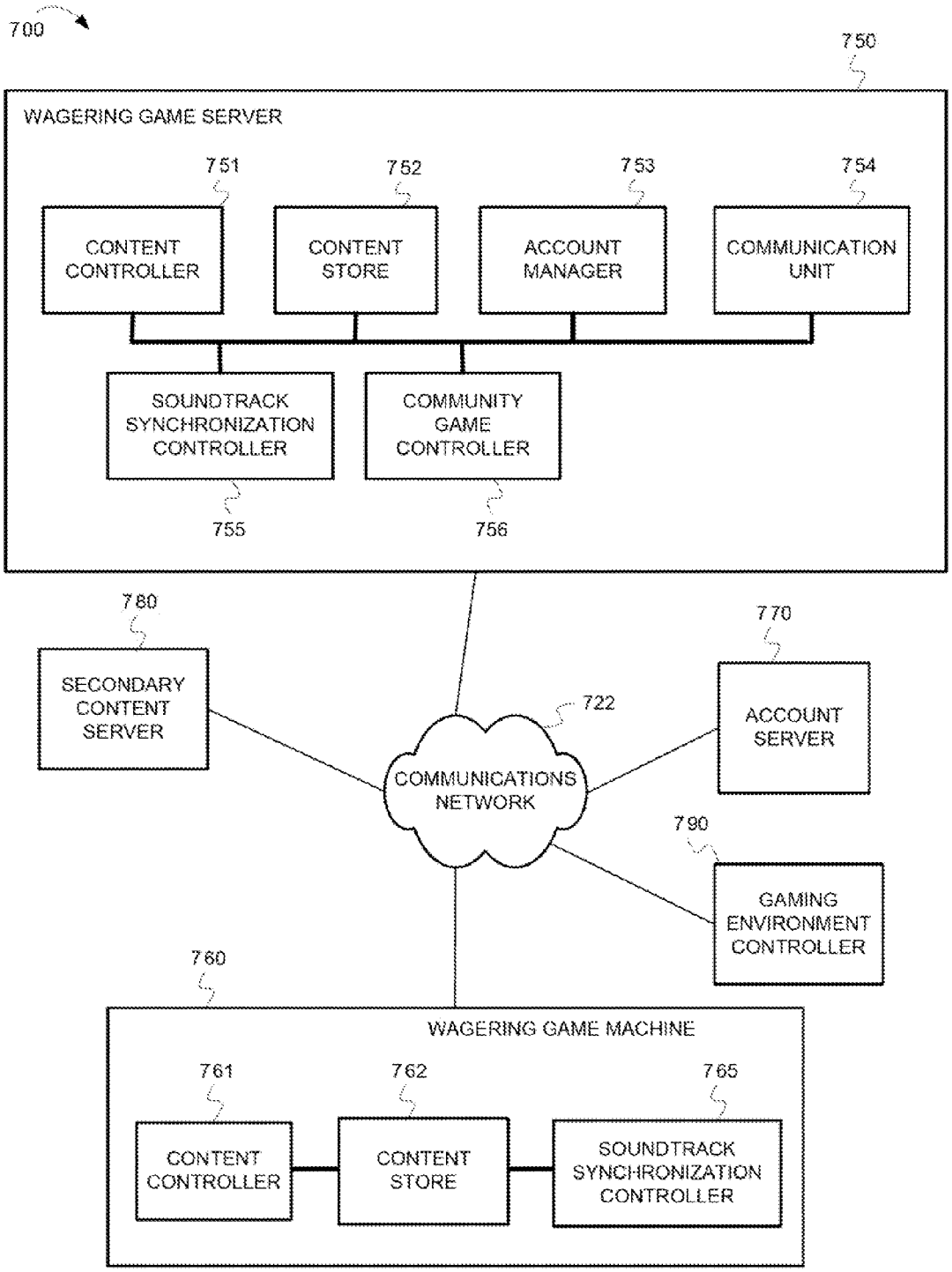
FIG. 7 is an illustration of a wagering game system architecture 700, according to some embodiments.

FIG. 7 is a conceptual diagram that illustrates an example of a wagering game system architecture 700, according to some embodiments. The wagering game system architecture 700 can include an account server 770 configured to control user related accounts accessible via wagering game networks and social networking networks. The account server 770 can store wagering game player account information, such as account settings (e.g., settings related to group games, settings related to social contacts, etc.), preferences (e.g., player preferences regarding volume settings, player preferences regarding award types, player preferences related to virtual assets, etc.), player profile data (e.g., name, avatar, screen name, etc.), and other information for a player's account (e.g., financial information, account identification numbers, virtual assets, social contact information, etc.). The account server 770 can contain lists of social contacts referenced by a player account. The account server 770 can also provide auditing capabilities, according to regulatory rules. The account server 770 can also track performance of players, machines, and servers.

The wagering game system architecture 700 can also include a wagering game server 750 configured to control wagering game content, provide random numbers, and communicate wagering game information, account information, and other information to and from a wagering game machine 760. The wagering game server 750 can include a content controller 751 configured to manage and control content for the presentation of content on the wagering game machine 760. For example, the content controller 751 can generate game results (e.g., win/loss values), including win amounts, for games played on the wagering game machine 760. The content controller 751 can communicate the game results to the wagering game machine 760. The content controller 751 can also generate random numbers and provide them to the wagering game machine 760 so that the wagering game machine 760 can generate game results. The wagering game server 750 can also include a content store 752 configured to contain content to present on the wagering game machine 760. The wagering game server 750 can also include an account manager 753 configured to control information related to player accounts. For example, the account manager 753 can communicate wager amounts, game results amounts (e.g., win amounts), bonus game amounts, etc., to the account server 770. The wagering game server 750 can also include a communication unit 754 configured to communicate information to the wagering game machine 760 and to communicate with other systems, devices and networks. The wagering game server 750 can also include a soundtrack synchronization controller 755 configured to control synchronization of soundtracks across multiple wagering game machines. The wagering game server 750 can also include a community game controller 756 configured to control community wagering games including community events associated with the community wagering games.

The wagering game system architecture 700 can also include a wagering game machine 760 configured to present wagering games and receive and transmit information to balance community wagering game audio. The wagering game machine 760 can include a content controller 761 configured to manage and control content and presentation of content on the wagering game machine 760. The wagering game machine 760 can also include a content store 762 configured to contain content to present on the wagering game machine 760 (e.g., game assets, sound assets, etc.). The wagering game machine 760 can also include a soundtrack synchronization controller 765 configured to control synchronization of soundtracks across multiple wagering game machines.

The wagering game system architecture 700 can also include a secondary content server 780 configured to provide content and control information for secondary games and other secondary content available on a wagering game network (e.g., secondary wagering game content, promotions content, advertising content, player tracking content, web content, etc.). The secondary content server 780 can provide "secondary" content, or content for "secondary" games presented on the wagering game machine 760. "Secondary" in some embodiments can refer to an application's importance or priority of the data. In some embodiments, "secondary" can refer to a distinction, or separation, from a primary application (e.g., separate application files, separate content, separate states, separate functions, separate processes, separate programming sources, separate processor threads, separate data, separate control, separate domains, etc.). Nevertheless, in some embodiments, secondary content and control can be passed between applications (e.g., via application protocol interfaces), thus becoming, or falling under the control of, primary content or primary applications, and vice versa. In some embodiments, the secondary content can be in one or more different formats, such as Adobe® Flash®, Microsoft® Silverlight™, Adobe® Air™, hyper-text markup language, etc. In some embodiments, the secondary content server 780 can provide and control content for community games, including networked games, social games, competitive games, or any other game that multiple players can participate in at the same time. In some embodiments, the secondary content server 780 can control and present an online website that hosts wagering games. The secondary content server 780 can also be configured to present multiple wagering game applications on the wagering game machine 760 via a wagering game website, or other gaming-type venue accessible via the Internet. The secondary content server 780 can host an online wagering website and/or a social networking website. The secondary content server 780 can include other devices, servers, mechanisms, etc., that provide functionality (e.g., controls, web pages, applications, etc.) that web users can use to connect to a social networking application and/or website and utilize social networking and website features (e.g., communications mechanisms, applications, etc.). The secondary content server 780 can also be configured to control soundtrack synchronization. In some embodiments, the secondary content server 780 can also host social networking accounts, provide social networking content, control social networking communications, store associated social contacts, etc. The secondary content server 780 can also provide chat functionality for a social networking website, a chat application, or any other social networking communications mechanism. In some embodiments, the secondary content server 780 can utilize player data to determine marketing promotions that may be of interest to a player account. The secondary content server 780 can also analyze player data and generate analytics for players, group players into demographics, integrate with third party marketing services and devices, etc. The secondary content server 780 can also provide player data to third parties that can use the player data for marketing.

The wagering game system architecture 700 can also include a gaming environment controller 790. The gaming environment controller can be configured to present environmental light and sound effects in a casino environment. The gaming environment controller 790 can further be configured to provide content data and user data, and to control information regarding gaming effects within a casino environment. For example, the gaming environment controller 790 can coordinate a synchronized presentation of lighting and sound effects across a bank of wagering game machines and/or other lighting and sound producing devices within one or more areas of a casino. The gaming environment controller 790 can also be configured to detect gaming events, such as events generated by the wagering game server 750 and/or the wagering game machine 760. The gaming environment controller 790 can generate data for a synchronized light/sound show based on the gaming events. The gaming environment controller 790 can control environmental light presentation devices within a casino. The gaming environment controller 790 can provide emotive lighting presentation data, including light presentation commands on emotive lighting devices on or near wagering game machines, as well as other devices within the casino such as spotlights, overhead emotive lighting, projectors, etc. The gaming environment controller 790 can be configured to determine multi-media, casino-content, including casino-wide special effects that include sound effects and light effects. The multi-media casino content can be presentable across a plurality of casino content presentation devices ("presentation devices") in a casino. The multi-media, casino-content effect can be related to a wagering game presentation or event. The wagering game presentation or event can be tied to the functionality, activity, or purpose of a wagering game. For instance, wagering game presentations can be related to attracting wagering game players to groups of wagering game machines, presenting game related outcomes across multiple wagering game machines, expressing group gaming activity across multiple wagering game machines, focusing attention on a particular person or machine in response to a gaming event, etc. The presentation devices present sound and light effects that accompany a gaming event (e.g., a jackpot celebratory effect that focuses on a wagering game machine, a lightning strike that introduces a community gaming event, and a musical chair game that reveals a community wagering game winner). The gaming environment controller 790 can also be configured to determine timing control data for the multi-media effect. In some embodiments, timing control data can be stored on the gaming environment controller 790, or be accessible to the gaming environment controller 790 via another device (e.g., a lighting controller associated with a bank of wagering game machines), to use to send lighting commands in sequential order to network addresses of presentation device on a casino network. The gaming environment controller 790 can determine channels assigned with casino-content presentation devices, such as the wagering game machine 760. In some embodiments, the presentation devices can have an addresses assigned to a channel. For example, the wagering game machine 760 could be on one channel, peripheral devices could be on another channel, network light presentation devices can be on other channels, etc. In some embodiments, the gaming environment controller 790 can be a DMX controller connected in parallel to an emotive lighting controller on, or associated with, the wagering game machine 760. The DMX controller can also be connected in parallel to a plurality of other presentation devices (e.g., other wagering game machines, lighting presentation devices, etc.) within a casino, and can simultaneously provide DMX lighting commands to the wagering game machine 760 and to the other presentation devices. DMX can change light intensity, or other light characteristics, over time. Some embodiments of DMX controllers can update commands very quickly (e.g., 30-47 times a second) across multiple channels (e.g., 512 channels). A DMX controller can put different commands in every channel (e.g., one channel can have show "X," one channel can have show "Y," etc.). The DMX can also have a frame number within a show. Some devices can take up more than one channel (e.g., an emotive light might have three colors and may take up a channel for each color, a spotlight might have seven channels, etc.). Each device can receive 512 bytes of data from the DMX controller at any given time interval (e.g., frame). The 512 bytes of data can be divided in different ways. For example, 6 bytes may address light effect behavior, 6 bytes may include show numbers, 6 bytes may include frame numbers, 1 byte may include priority values, and so on for various light effect characteristics (e.g., intensity, color, pan, tilt, etc.). The presentation device that receives the DMX command data is programmed to interpret the lighting data in the channel. In some embodiments, the presentation devices can be DMX compliant including having a DMX input port to accept DMX commands. In some embodiments, presentation devices can convert the DMX commands to proprietary commands. In addition to the DMX protocol, other types of dedicated lighting protocols can include AMX-192, CMX, SMX, PMX, protocols included in the EIA-485 standard, etc.

Each component shown in the wagering game system architecture 700 is shown as a separate and distinct element connected via a communications network 722. However, some functions performed by one component could be performed by other components. For example, the wagering game server 750 can also be configured to perform functions of the secondary content server 780, the account server 770, and other network elements and/or system devices. Furthermore, the components shown may all be contained in one device, but some, or all, may be included in, or performed by, multiple devices, as in the configurations shown in FIG. 7 or other configurations not shown. For example, the account manager 753 and the communication unit 754 can be included in the wagering game machine 760 instead of, or in addition to, being a part of the wagering game server 750. Further, in some embodiments, the wagering game machine 760 can determine wagering game outcomes, generate random numbers, etc. instead of, or in addition to, the wagering game server 750.

The wagering game machines described herein (e.g., wagering game machine 760) can take any suitable form, such as floor standing models, handheld mobile units, bartop models, workstation-type console models, surface computing machines, etc. Further, wagering game machines can be primarily dedicated for use in conducting wagering games, or can include non-dedicated devices, such as mobile phones, personal digital assistants, personal computers, etc.

In some embodiments, wagering game machines and wagering game servers work together such that wagering game machines can be operated as thin, thick, or intermediate clients. For example, one or more elements of game play may be controlled by the wagering game machines (client) or the wagering game servers (server). Game play elements can include executable game code, lookup tables, configuration files, game outcome, audio or visual representations of the game, game assets or the like. In a thin-client example, the wagering game server can perform functions such as determining game outcome or managing assets, while the wagering game machines can present a graphical representation of such outcome or asset modification to the user (e.g., player). In a thick-client example, the wagering game machines can determine game outcomes and communicate the outcomes to the wagering game server for recording or managing a player's account.

In some embodiments, either the wagering game machines (client) or the wagering game server(s) can provide functionality that is not directly related to game play. For example, account transactions and account rules may be managed centrally (e.g., by the wagering game server(s)) or locally (e.g., by the wagering game machines). Other functionality not directly related to game play may include power management, presentation of advertising, software or firmware updates, system quality or security checks, etc.

Furthermore, the wagering game system architecture 700 can be implemented as software, hardware, any combination thereof, or other forms of embodiments not listed. For example, any of the network components (e.g., the wagering game machines, servers, etc.) can include hardware and machine-readable storage media including instructions for performing the operations described herein.

Wagering Game Machine Architecture

Figure 8:
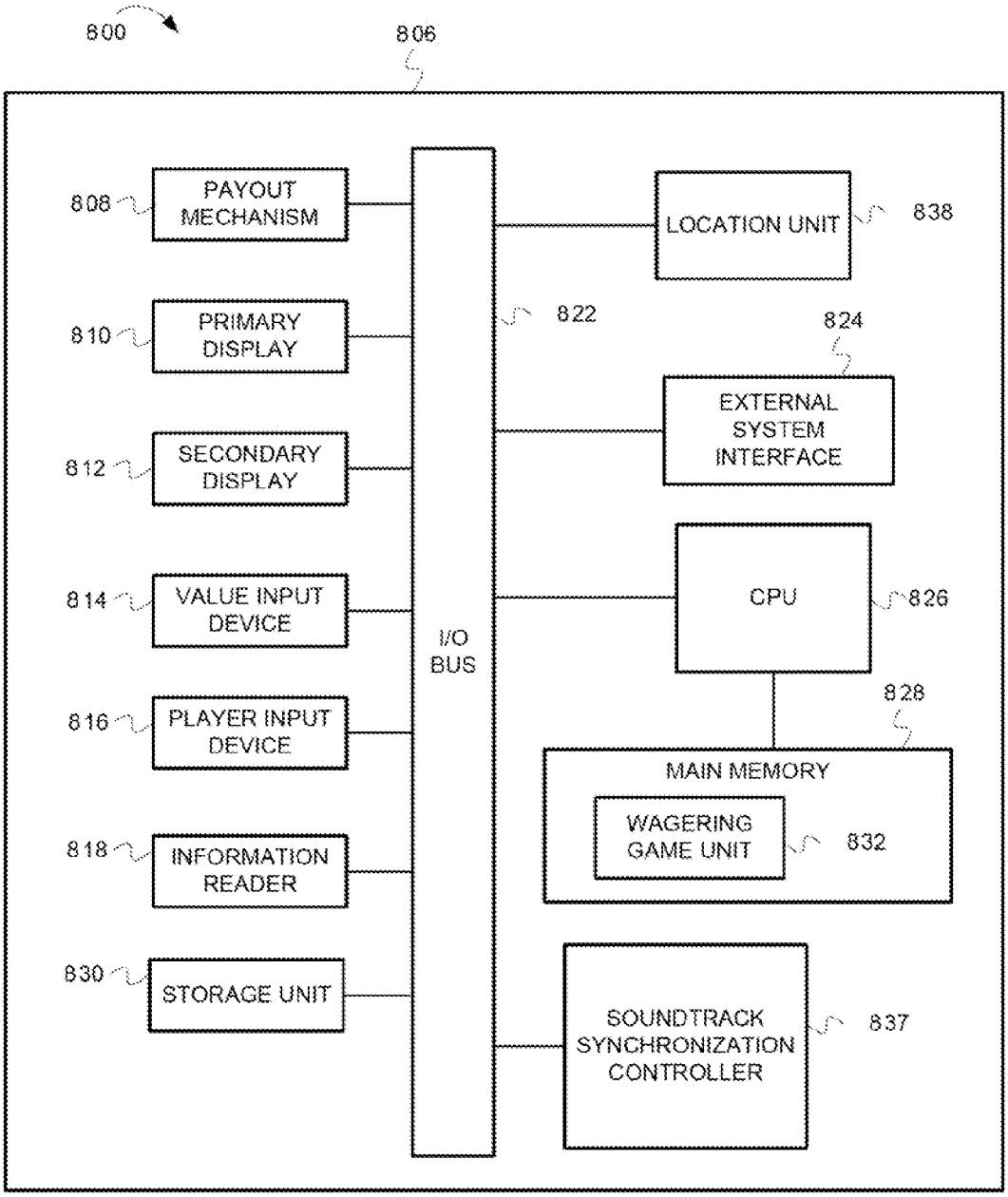
FIG. 8 is an illustration of a wagering game machine architecture 800, according to some embodiments.

FIG. 8 is a conceptual diagram that illustrates an example of a wagering game machine architecture 800, according to some embodiments. In FIG. 8, the wagering game machine architecture 800 includes a wagering game machine 806, which includes a central processing unit (CPU) 826 connected to main memory 828. The CPU 826 can include any suitable processor, such as an Intel® Pentium processor, Intel® Core 2 Duo processor, AMD Opteron™ processor, or UltraSPARC processor. The main memory 828 includes a wagering game unit 832. In some embodiments, the wagering game unit 832 can present wagering games, such as video poker, video black jack, video slots, video lottery, reel slots, etc., in whole or part.

The CPU 826 is also connected to an input/output ("I/O") bus 822, which can include any suitable bus technologies, such as an AGTL+ frontside bus and a PCI backside bus. The I/O bus 822 is connected to a payout mechanism 808, primary display 810, secondary display 812, value input device 814, player input device 816, information reader 818, and storage unit 830. The player input device 816 can include the value input device 814 to the extent the player input device 816 is used to place wagers. The I/O bus 822 is also connected to an external system interface 824, which is connected to external systems (e.g., wagering game networks). The external system interface 824 can include logic for exchanging information over wired and wireless networks (e.g., 802.11g transceiver, Bluetooth transceiver, Ethernet transceiver, etc.)

The I/O bus 822 is also connected to a location unit 838. The location unit 838 can create player information that indicates the wagering game machine's location/movements in a casino. In some embodiments, the location unit 838 includes a global positioning system (GPS) receiver that can determine the wagering game machine's location using GPS satellites. In other embodiments, the location unit 838 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 8, in some embodiments, the location unit 838 is not connected to the I/O bus 822.

In some embodiments, the wagering game machine 806 can include additional peripheral devices and/or more than one of each component shown in FIG. 8. For example, in some embodiments, the wagering game machine 806 can include multiple external system interfaces 824 and/or multiple CPUs 826. In some embodiments, any of the components can be integrated or subdivided.

In some embodiments, the wagering game machine 806 includes a soundtrack synchronization module 837. The soundtrack synchronization module 837 can process communications, commands, or other information, where the processing can control synchronization of soundtracks across multiple wagering game machines.

Furthermore, any component of the wagering game machine 806 can include hardware, firmware, and/or machine-readable storage media including instructions for performing the operations described herein.

Wagering Game Machine

Figure 9:
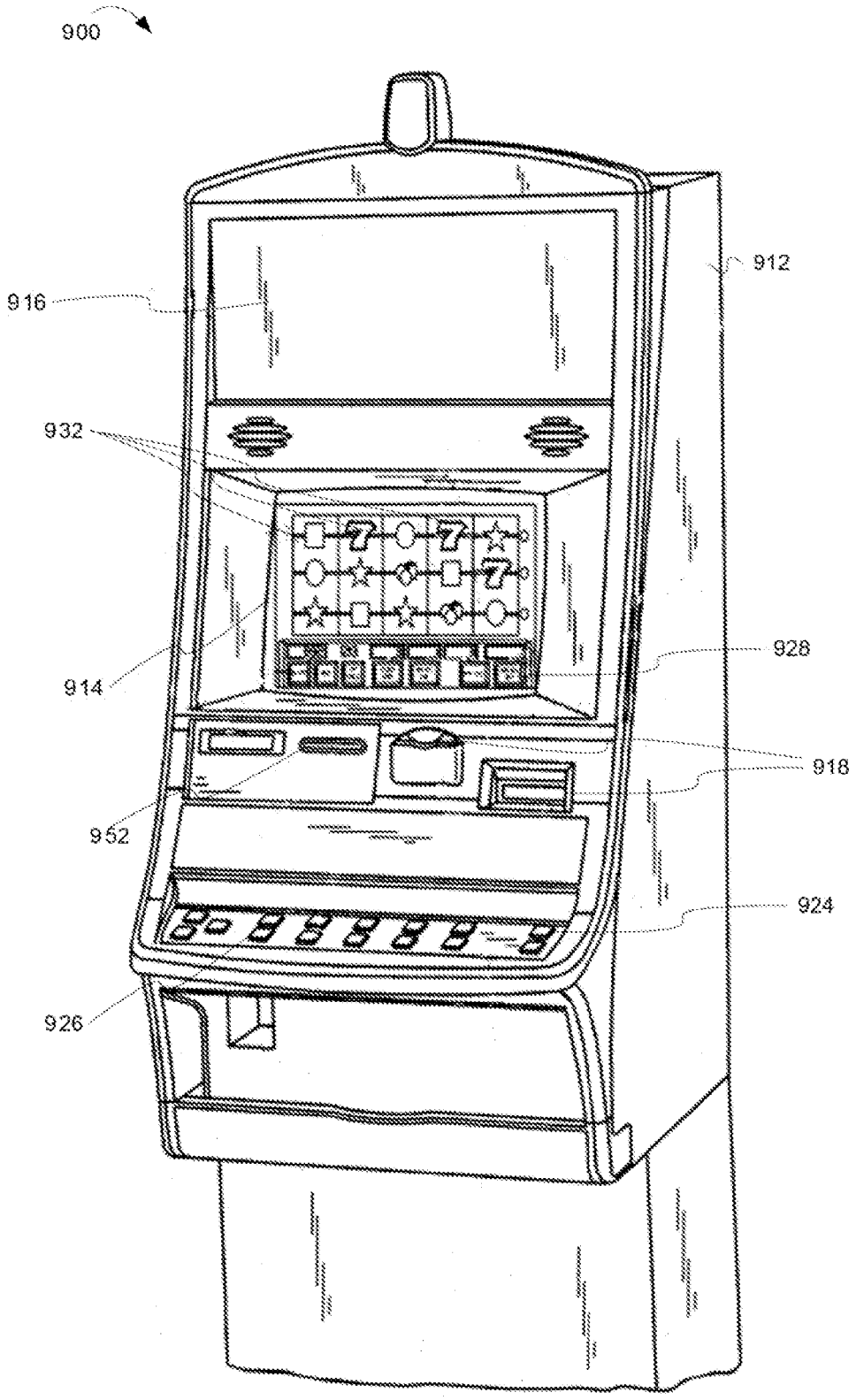
FIG. 9 is an illustration of a wagering game machine 900, according to some embodiments.

FIG. 9 is a conceptual diagram that illustrates an example of a wagering game machine 900, according to some embodiments. Referring to FIG. 9, the wagering game machine 900 can be used in gaming establishments, such as casinos. According to some embodiments, the wagering game machine 900 can be any type of wagering game machine and can have varying structures and methods of operation. For example, the wagering game machine 900 can be an electromechanical wagering game machine configured to play mechanical slots, or it can be an electronic wagering game machine configured to play video casino games, such as blackjack, slots, keno, poker, blackjack, roulette, etc.

The wagering game machine 900 comprises a housing 912 and includes input devices, including value input devices 918 and a player input device 924. For output, the wagering game machine 900 includes a primary display 914 for displaying information about a basic wagering game. The primary display 914 can also display information about a bonus wagering game and a progressive wagering game. The wagering game machine 900 also includes a secondary display 916 for displaying wagering game events, wagering game outcomes, and/or signage information. While some components of the wagering game machine 900 are described herein, numerous other elements can exist and can be used in any number or combination to create varying forms of the wagering game machine 900.

The value input devices 918 can take any suitable form and can be located on the front of the housing 912. The value input devices 918 can receive currency and/or credits inserted by a player. The value input devices 918 can include coin acceptors for receiving coin currency and bill acceptors for receiving paper currency. Furthermore, the value input devices 918 can include ticket readers or barcode scanners for reading information stored on vouchers, cards, or other tangible portable storage devices. The vouchers or cards can authorize access to central accounts, which can transfer money to the wagering game machine 900.

The player input device 924 comprises a plurality of push buttons on a button panel 926 for operating the wagering game machine 900. In addition, or alternatively, the player input device 924 can comprise a touch screen 928 mounted over the primary display 914 and/or secondary display 916.

The various components of the wagering game machine 900 can be connected directly to, or contained within, the housing 912. Alternatively, some of the wagering game machine's components can be located outside of the housing 912, while being communicatively coupled with the wagering game machine 900 using any suitable wired or wireless communication technology.

The operation of the basic wagering game can be displayed to the player on the primary display 914. The primary display 914 can also display a bonus game associated with the basic wagering game. The primary display 914 can include a cathode ray tube (CRT), a high resolution liquid crystal display (LCD), a plasma display, light emitting diodes (LEDs), or any other type of display suitable for use in the wagering game machine 900. Alternatively, the primary display 914 can include a number of mechanical reels to display the outcome. In FIG. 9, the wagering game machine 900 is an "upright" version in which the primary display 914 is oriented vertically relative to the player. Alternatively, the wagering game machine can be a "slant-top" version in which the primary display 914 is slanted at about a thirty-degree angle toward the player of the wagering game machine 900. In yet another embodiment, the wagering game machine 900 can exhibit any suitable form factor, such as a free standing model, bar top model, mobile handheld model, or workstation console model.

A player begins playing a basic wagering game by making a wager via the value input device 918. The player can initiate play by using the player input device's buttons or touch screen 928. The basic game can include arranging a plurality of symbols 932 along a pay line, which indicates one or more outcomes of the basic game. Such outcomes can be randomly selected in response to player input. At least one of the outcomes, which can include any variation or combination of symbols, can trigger a bonus game.

In some embodiments, the wagering game machine 900 can also include an information reader 952, which can include a card reader, ticket reader, bar code scanner, RFID transceiver, or computer readable storage medium interface. In some embodiments, the information reader 952 can be used to award complimentary services, restore game assets, track player habits, etc.

Embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments of the inventive subject matter may take the form of a computer program product embodied in any tangible medium of expression having computer readable program code embodied in the medium. The described embodiments may be provided as a computer program product, or software, that may include a machine-readable storage medium having stored thereon instructions, which may be used to program a computer system (or other electronic device(s)) to perform a process according to embodiments(s), whether presently described or not, because every conceivable variation is not enumerated herein. A machine-readable storage medium includes any mechanism that stores information in a form readable by a machine (e.g., a wagering game machine, computer, etc.). For example, machine-readable storage media includes read only memory (ROM), random access memory (RAM), magnetic disk storage media, optical storage media (e.g., CD-ROM), flash memory machines, erasable programmable memory (e.g., EPROM and EEPROM); etc. Some embodiments of the invention can also include machine-readable signal media, such as any media suitable for transmitting software over a network.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. A method of operating an electronic controller, said method comprising:

detecting, by the electronic controller, a trigger associated with a first wagering game machine, wherein the trigger initiates play of wagering game content via the first wagering game machine, wherein the wagering game content uses a soundtrack, wherein a second wagering game machine has not initiated play of the wagering game content, wherein the first wagering game machine includes a value input device configured to electronically detect a tangible form of money causing a credit balance of the first wagering game machine to increase in value, wherein the first wagering game machine includes a player input device configured to detect player input for placement of a wager on a possible game outcome of the wagering game content, wherein the first wagering game machine deducts monetary value from the credit balance in response to the player input, and wherein the first wagering game machine includes a payout mechanism for payment of at least a portion of the credit balance;

initiating, by the electronic controller, simultaneous play, at a common starting point, of a first instance of the soundtrack via the first wagering game machine and a second instance of the soundtrack via the second wagering game machine in response to detecting the trigger, wherein the first instance of the soundtrack plays at an audible volume level while play of the wagering game content is presented at the first wagering game machine, and wherein the second instance of the soundtrack plays at an inaudible volume level via the second wagering game machine while the second wagering game machine does not present the play of the wagering game content;

detecting, by the electronic controller, an additional trigger after initiation of the simultaneous play, at the common starting point, of the first instance of the soundtrack and the second instance of the soundtrack, wherein the additional trigger is associated with initiation of play of the wagering game content at the second wagering game machine; and modifying, by the electronic controller, the inaudible volume level of the second instance of the soundtrack to be an additional audible volume level in response to detecting the additional trigger.

2. The method of claim 1, wherein the initiating the simultaneous play, at the common starting point, of the first instance of the soundtrack via the first wagering game machine and the second instance of the soundtrack via the second wagering game machine is at least partially in response to detecting that the second wagering game machine is within a specific distance to the first wagering game machine.

3. The method of claim 1 further comprising:

setting a first volume setting for the first instance of the soundtrack via the first wagering game machine to the audible volume level; and setting a second volume setting for the second instance of the soundtrack via the second wagering game machine to a muted volume level.

4. The method of claim 1, wherein the trigger indicates an occurrence of a wagering game event in a primary wagering game that initiates play of a bonus game via the first wagering game machine, wherein the second wagering game machine is configured to present the primary wagering game and the bonus game.

5. The method of claim 1 further comprising:

using a repeating timing signal pulse based on a clock of the first wagering game machine to synchronize a presentation of the first instance of the soundtrack via the first wagering game machine and the second instance of the soundtrack via the second wagering game machine.

6. One or more non-transitory, machine-readable storage media having instructions stored thereon, which when executed by a set of one or more processors cause the set of one or more processors to perform operations comprising:

detecting, by an electronic controller, a first triggering event that initiates play of first wagering game content via a first wagering game machine, wherein the first wagering game content uses a soundtrack, wherein the first wagering game machine includes a value input device configured to electronically detect a tangible form of money causing a credit balance of the first wagering game machine to increase in value, wherein the first wagering game machine includes a player input device configured to detect player input for placement of a wager on a possible game outcome of the first wagering game content, wherein the first wagering game machine deducts monetary value from the credit balance in response to the player input, and wherein the first wagering game machine includes a payout mechanism for payment of at least a portion of the credit balance;

determining that a second wagering game machine, which has not experienced a second triggering event to initiate play of second wagering game content, is eligible to initiate play of the second wagering game content when the first wagering game machine presents play of the first wagering game content, and wherein the second wagering game content is configured to use the soundtrack;

automatically initiating, by the electronic controller, play of the soundtrack at a same moment, from a common starting point, via the first wagering game machine and the second wagering game machine;

causing, by the electronic controller, the soundtrack to audibly play via the first wagering game machine as the first wagering game machine presents the play of first wagering game content while simultaneously causing the soundtrack to inaudibly play in unison via the second wagering game machine while the second wagering game machine does not present the play of second wagering game content;

detecting, by the electronic controller, the second triggering event that initiates play of the second wagering game content after initiation of the play of the soundtrack, from the common starting point, via the first wagering game machine and the second wagering game machine; and modifying, by the electronic controller, a volume level for the soundtrack at the second wagering game machine to be audible in response to detection of the second triggering event, wherein the soundtrack audibly plays in unison on the first wagering game machine and on the second wagering game machine.

7. The one or more non-transitory, machine-readable storage media of claim 6, said operations further comprising:

in response to detecting the first triggering event setting a first volume setting for a first sound asset stored on the first wagering game machine to have an audible volume level, wherein the first sound asset uses the soundtrack;

setting a second volume setting for a second sound asset stored on the second wagering game machine to have a muted volume level, wherein the first sound asset is configured to use the soundtrack; and using the second volume setting to initiate the play of the second sound asset at the muted volume level, and, at the same moment initiating play of the soundtrack from speakers associated with the first wagering game machine at the first volume setting.

8. The one or more non-transitory, machine-readable storage media of claim 6, wherein causing the soundtrack to inaudibly play in unison via the second wagering game machine includes operations comprising:

detecting a volume level of an audio field for the soundtrack produced on first speakers for the first wagering game machine; and presenting the soundtrack on second speakers associated with the second wagering game machine at a volume level that is inaudible over the audio field for the soundtrack produced on the first speakers for the first wagering game machine.

9. The one or more non-transitory, machine-readable storage media of claim 6, said operations further comprising:

detecting that the second wagering game machine is within a given distance to the first wagering game machine; and causing the soundtrack to audibly play via the first wagering game machine while simultaneously causing the soundtrack to inaudibly play in unison via the second wagering game machine in response to determining that the second wagering game machine is within the given distance to the first wagering game machine.

10. The one or more non-transitory, machine-readable storage media of claim 6, said operations further comprising:

detecting that a first wagering game player account associated with the first wagering game machine is linked to a second wagering game player account associated with the second wagering game machine; and causing the soundtrack to audibly play via the first wagering game machine while simultaneously causing the soundtrack to inaudibly play in unison via the second wagering game machine in response to determining that the first wagering game player account is linked to the second wagering game player account.

11. A system comprising:

a plurality of wagering game machines configured to present common wagering game content, wherein the plurality of the wagering game machines are grouped together, wherein a first of the plurality of the wagering game machines includes a value input device configured to electronically detect a tangible form of money causing a credit balance of the first of the plurality of the wagering game machines to increase in value, wherein the first of the plurality of the wagering game machines includes a player input device configured to detect player input for placement of a wager on a possible game outcome of the common wagering game content, wherein the first of the plurality of the wagering game machines deducts monetary value from the credit balance in response to the player input, and wherein the first of the plurality of the wagering game machines includes a payout mechanism for payment of at least a portion of the credit balance; and a server configured to detect a first trigger from the first of the plurality of the wagering game machines, wherein the first trigger initiates presentation of the common wagering game content at the first of the plurality of the wagering game machines, and wherein a second of the plurality of the wagering game machines does not present play of the common wagering game content at a time of occurrence of the first trigger, stream a soundtrack associated with the common wagering game content in synchronicity to the plurality of the wagering game machines in response to detecting the first trigger from the first of the plurality of the wagering game machines, cause the soundtrack to play audibly, at a first audible volume level, from the first of the plurality of the wagering game machines in response to detecting the first trigger, cause the soundtrack to inaudibly play, at an inaudible volume level, via the second of the plurality of the wagering game machines when the second of the plurality of the wagering game machines does not present play of the common wagering game content, detect a second trigger associated with initiation of play of the common wagering game content via the second of the plurality of the wagering game machines after causing the soundtrack to play inaudibly from the second of the plurality of the wagering game machines, and in response to detecting the second trigger, cause the soundtrack at the second of the plurality of the wagering game machines to play at a second audible volume level, wherein the soundtrack audibly plays in unison on the first of the plurality of the wagering game machines and on the second of the plurality of the wagering game machines.

12. The system of claim 11, wherein the server configured to stream the soundtrack associated with the common wagering game content in synchronicity to the plurality of the wagering game machines is configured to set the first audible volume level for the soundtrack associated with the first of the plurality of the wagering game machines, and concurrently set the inaudible volume level for the soundtrack associated with the second of the plurality of the wagering game machines.

13. The system of claim 11, wherein the server configured to stream the soundtrack associated with the common wagering game content in synchronicity to the plurality of the wagering game machines is configured to assign a first communication channel to the first of the plurality of the wagering game machines, assign an additional communication channel to the second of the plurality of the wagering game machines, and stream a first instance of the soundtrack via the first communication channel at an audible sound level while streaming an additional instance of the soundtrack via the additional communication channel at a muted sound level.

14. An apparatus comprising:

a processor; and a soundtrack synchronization controller configured to, via the processor, detect a trigger associated with a first wagering game machine, wherein the trigger initiates play of a wagering game via the first wagering game machine, wherein the first wagering game machine and a second wagering game machine are configured to play an identical soundtrack associated with the wagering game, wherein the second wagering game machine has not initiated play of the wagering game, wherein the first wagering game machine includes a value input device configured to electronically detect a tangible form of money causing a credit balance of the first wagering game machine to increase in value, wherein the first wagering game machine includes a player input device configured to detect player input for placement of a wager on a possible game outcome of the wagering game, wherein the first wagering game machine deducts monetary value from the credit balance in response to the player input, and wherein the first wagering game machine includes a payout mechanism for payment of at least a portion of the credit balance, in response to the trigger associated with the first wagering game machine, initiate play of the soundtrack in unison via the first wagering game machine at an audible volume level while the wagering game is presented at the first wagering game machine and via the second wagering game machine at an inaudible volume level while the second wagering game machine does not present the wagering game, generate a repeating timing signal pulse, and synchronize play of the soundtrack via the first wagering game machine and via the second wagering game machine using the repeating timing signal pulse.

15. The apparatus of claim 14, wherein the soundtrack synchronization controller is further configured to generate the repeating timing signal pulse based on a clock of the first wagering game machine.

16. The apparatus of claim 14, wherein the soundtrack synchronization controller is further configured to use the repeating timing signal pulse to correct a degree of timing variance between play of the soundtrack via the second wagering game machine from play of the soundtrack via the first wagering game machine, wherein the soundtrack synchronization controller is configured to correct the degree of timing variance before the degree of the timing variance is large enough to produce a distinguishable audio difference between audible play of the soundtrack via the first wagering game machine and via the second wagering game machine.

17. The apparatus of claim 14, wherein the timing signal pulse mirrors a time measurement within the soundtrack.

18. The apparatus of claim 14, wherein the trigger indicates an occurrence of a wagering game event associated with the first wagering game machine, and wherein the soundtrack synchronization controller is further configured to:

detect an additional trigger that indicates a stop of the wagering game event associated with the first wagering game machine;

determine that the soundtrack is playing on the second wagering game machine at the inaudible volume level; and stop play of the soundtrack on both the first wagering game machine and the second wagering game machine in response to the additional trigger.

19. The apparatus of claim 14, wherein the trigger is associated with a secondary wagering game.

20. An apparatus comprising:

means for detecting a first triggering event that initiates play of a first wagering game content via a first wagering game machine, wherein the first wagering game content uses a first sound asset stored on the first wagering game machine, wherein the first sound asset is configured to present a soundtrack, wherein the first wagering game machine includes a value input device configured to electronically detect a tangible form of money causing a credit balance of the first wagering game machine to increase in value, wherein the first wagering game machine includes a player input device configured to detect player input for placement of a wager on a possible game outcome of the first wagering game content, wherein the first wagering game machine deducts monetary value from the credit balance in response to the player input, and wherein the first wagering game machine includes a payout mechanism for payment at least a portion of the credit balance;

means for detecting that a second wagering game machine is within a given distance to the first wagering game machine, wherein a second sound asset, associated with second wagering game content, is stored on the second wagering game machine, wherein the second sound asset is configured to present the soundtrack, and wherein the second wagering game machine has not initiated presentation of the second wagering game content;

means for initiating play of the first sound asset and at a same moment, from a common starting point, initiating play of the second sound asset via the second wagering game machine;

means for causing the soundtrack to audibly play on the first wagering game machine as the first wagering game machine presents the first wagering game content while simultaneously causing the soundtrack to inaudibly play in unison on the second wagering game machine while the second wagering game machine does not present the second wagering game content;

means for detecting a second triggering event that initiates play of the second wagering game content via the second wagering game machine after initiating the play of the first sound asset and the second sound asset at the same moment;

means for modifying a volume level for the soundtrack at the second wagering game machine to be audible and to play in unison with the soundtrack on the first wagering game machine without restarting the presentation of the soundtrack on the first wagering game machine; and means for using a repeating timing signal pulse based on a clock of the first wagering game machine to synchronize a presentation of the soundtrack via the first wagering game machine and via the second wagering game machine.

21. The apparatus of claim 20 further comprising:

means for setting a first volume setting for the first sound asset to have an audible volume level;

means for setting a second volume setting for the second sound asset to have a muted volume level; and means for using the second volume setting to initiate the play of the second sound asset at the muted volume level, and, at the same moment initiating play of the soundtrack from speakers associated with the first wagering game machine using the audible volume level of the first volume setting.

* * * * *